US008082700B2

(12) United States Patent
Kennedy et al.

(10) Patent No.: US 8,082,700 B2
(45) Date of Patent: Dec. 27, 2011

(54) PORTABLE ARCH BUILDING STRUCTURE

(75) Inventors: Miles Kennedy, Dunrobin (CA); Mark Edey, Ottawa (CA); Reinier Halbertsma, Ottawa (CA); Aldo Balatti, Ottawa (CA)

(73) Assignee: Housall Systems Corporation, Dunrobin, Ontario (CA)

( * ) Notice: Subject to any disclaimer, the term of this patent is extended or adjusted under 35 U.S.C. 154(b) by 289 days.

(21) Appl. No.: 12/293,051

(22) PCT Filed: Mar. 13, 2007

(86) PCT No.: PCT/CA2007/000399
§ 371 (c)(1),
(2), (4) Date: Feb. 12, 2009

(87) PCT Pub. No.: WO2007/104147

PCT Pub. Date: Sep. 20, 2007

(65) Prior Publication Data

US 2009/0217617 A1 Sep. 3, 2009

Related U.S. Application Data

(60) Provisional application No. 60/781,320, filed on Mar. 13, 2006.

(51) Int. Cl.
*E04B 1/32* (2006.01)
*E04H 15/36* (2006.01)

(52) U.S. Cl. ..... 52/86; 52/79.12; 52/222; 52/639; 52/643; 52/644; 135/124; 135/125; 135/906

(58) Field of Classification Search ..... 52/79.12, 52/86, 222, 223.6, 783.1, 790.1, 793.11, 52/245, 285.1, 285.4, 284, 585.1, 639, 643, 52/644; 160/352; 135/124, 125, 906
See application file for complete search history.

(56) References Cited

U.S. PATENT DOCUMENTS 970,873 A 9/1910 Bear
2,270,161 A * 1/1942 Briggs ..... 52/93.2
(Continued)

FOREIGN PATENT DOCUMENTS

CA 2082465 A1 5/1994
(Continued)

OTHER PUBLICATIONS

Derwent-ACC-No. 2003-681818, English Abstract of DE 20310263, published Sep. 2003.*

(Continued)

*Primary Examiner* — Robert Canfield
(74) *Attorney, Agent, or Firm* — Sterne, Kessler, Goldstein & Fox P.L.L.C.

(57) ABSTRACT

A building structure with a tubular frame structure in a hut shape may be provided with cladding in the form of curved panels to provide a temporary or emergency shelter. These panels may consist of two spaced-apart plastic sheets fused together by parallel ribs serving as webs to provide parallel channels therein, e.g., Coroplast™-like sheeting. Such sheeting is preferably stiffening with one or more battens that are inserted through the hollow channels of the panel allowing them to be used as semi-rigid cladding over the entire building structure. The outer tubular members of the frame are all curved to improve rigidity. The frame includes channels for seating the panels as well as contribute to the structural integrity of the shelter.

24 Claims, 14 Drawing Sheets

U.S. PATENT DOCUMENTS

| | | | | | |
|---|---|---|---|---|---|
| 2,278,797 | A | * | 4/1942 | Raymond | 52/89 |
| 2,323,106 | A | * | 6/1943 | Whiteman | 52/66 |
| 2,828,756 | A | * | 4/1958 | Worley | 135/97 |
| 2,988,810 | A | * | 6/1961 | Wilken | 52/86 |
| 3,629,982 | A | | 12/1971 | Ballay et al. | |
| 3,662,507 | A | | 5/1972 | Espeland | |
| 3,749,107 | A | | 7/1973 | Laberge | |
| 4,057,284 | A | | 11/1977 | Blank | |
| 4,433,700 | A | * | 2/1984 | Dohet | |
| 4,536,997 | A | * | 8/1985 | Heescher | 52/86 |
| 4,569,166 | A | * | 2/1986 | Buchmuller et al. | 52/86 |
| 4,676,045 | A | * | 6/1987 | Ellen | 52/745.2 |
| 4,682,460 | A | * | 7/1987 | Reetz | |
| 4,745,724 | A | * | 5/1988 | Reetz | |
| 4,890,429 | A | * | 1/1990 | Gatzka et al. | 52/640 |
| 5,252,002 | A | | 10/1993 | Day | |
| 5,269,106 | A | * | 12/1993 | Stafford et al. | 52/63 |
| 5,333,421 | A | * | 8/1994 | McKenna | 52/86 |
| 5,423,281 | A | | 6/1995 | Crookham et al. | |
| 5,595,203 | A | | 1/1997 | Espinosa | |
| 5,595,233 | A | * | 1/1997 | Gower | 160/232 |
| 5,611,178 | A | | 3/1997 | Aubert | |
| 5,680,828 | A | | 10/1997 | Totten | |
| 5,706,620 | A | | 1/1998 | De Zen | |
| 5,966,203 | A | | 10/1999 | Bowen | |
| 6,026,613 | A | * | 2/2000 | Quiring et al. | |
| 6,085,468 | A | * | 7/2000 | Quiring et al. | |
| 6,131,343 | A | | 10/2000 | Jackson, Jr. | |
| 6,178,673 | B1 | | 1/2001 | Blackford et al. | |
| 6,276,083 | B1 | | 8/2001 | Ross | |
| 6,286,579 | B1 | * | 9/2001 | Gottschalk | 160/264 |
| 6,308,486 | B1 | | 10/2001 | Medland | |
| 6,328,470 | B2 | | 12/2001 | Brown et al. | |
| 6,434,891 | B1 | | 8/2002 | Cameron | |
| 6,679,009 | B2 | | 1/2004 | Hotes | |
| 6,845,580 | B2 | | 1/2005 | Noble | |
| 6,948,281 | B1 | | 9/2005 | Carmichael | |
| 6,952,900 | B2 | * | 10/2005 | Leurent | 52/86 |
| 7,127,865 | B2 | * | 10/2006 | Douglas | |
| D568,495 | S | * | 5/2008 | Kennedy et al. | D25/1 |
| 7,735,502 | B1 | * | 6/2010 | Hotes | 135/91 |
| 2002/0108646 | A1 | * | 8/2002 | Hotes | 135/124 |
| 2004/0134162 | A1 | * | 7/2004 | Douglas | |
| 2007/0107370 | A1 | * | 5/2007 | Douglas | |
| 2010/0126545 | A1 | * | 5/2010 | Bullivant et al. | 135/125 |

FOREIGN PATENT DOCUMENTS

| | | | | |
|---|---|---|---|---|
| CA | 2501869 | | * | 4/2004 |
| CN | 1430692 | A | | 7/2003 |
| DE | 33 29 812 | A1 | | 2/1985 |
| DE | 92 16 294 | U1 | | 4/1993 |
| DE | 20310263 | | * | 9/2003 |
| GB | 2 382 595 | | | 6/2003 |
| WO | WO 83/04064 | | * | 11/1983 |
| WO | WO 00/61380 | A1 | | 10/2000 |
| WO | WO 01/83904 | A1 | | 11/2001 |

OTHER PUBLICATIONS

International Search Report for International Application No. PCT/CA2007/000399, mailed on Jul. 5, 2007.

International Preliminary Report on Patentability for International Application No. PCT/CA2007/000399, Geneva, Switzerland, issued Sep. 16, 2008, 9 pages.

European Search Report and Opinion for European Application No. 07 71 0730, European Patent Office, The Hague, dated May 18, 2010, 8 pages.

International Search Report for International Application No. PCT/CA2007/000399, Canadian Patent Office, mailed Jul. 5, 2007, 3 pages.

* cited by examiner 137
139

106
108
108
109
112
112
113
120
121
126
131
132
133
134
135
137

134
136

134
136

114
115
121
122
123
124
125
127
135

200
206
215
149
207
208
211
209

208
211
200
215
206
145
209
207
205

11B
11B
11A
11A
104
149
149

PORTABLE ARCH BUILDING STRUCTURE

This specification is based upon U.S. Provisional Application 60/781,320 filed Mar. 13, 2006, the contents of which, where consistent with the present document, are adopted expressly herein.

BACKGROUND OF THE INVENTION

1. Field of the Invention

This invention relates to, according to British usage, a Nissen-hut type building structure of generally semi-cylindrical design incorporating certain novel components. Certain such components are building panels in the form of stiffened sheeting panels suited, amongst other applications, for cladding the wall and roofing surfaces of a building structure. More particularly, this application relates to other novel components of such Nissen hut-like structures.

2. Background and Description of the Prior Art

Panels formed from thermoplastic materials, e.g., polyethylene, polypropylene etc, are currently commercially available under the trademark COROPLAST. These panels are formed of two sheets of spaced-apart thermoplastic material that are united by a plurality of spaced-apart, longitudinally extending webs. These panels have many uses. For example, see the following patents:

U.S. Pat. No. 6,845,580 patented Jan. 25, 2005, by Innovation Sports Marketing Inc for a reflective signage.

U.S. Pat. No. 6,328,470, patented Dec. 11, 2001 by B.A.G. Corp for flexible containers with support members.

U.S. Pat. No. 6,276,083, patented Aug. 21, 2001 for apparatus for displaying advertising materials.

U.S. Pat. No. 6,178,673, patented Jan. 30, 2001 for wind responsive display device.

U.S. Pat. No. 5,966,203, patented Oct. 12, 1999 by M. L. Bowen for vacuum easel.

U.S. Pat. No. 5,680,828, patented Oct. 28, 1997 for kayaks.

U.S. Pat. No. 5,423,281, patented Jun. 13, 1995 by Musco Corp for banners.

In addition, such panels have been used as walls for building structures. For example, see the following patents:

U.S. Pat. No. 6,308,486 patented Oct. 30, 2001, by T. Medland;

U.S. Pat. No. 5,706,620 patented Jan. 13, 1998 by Royal Building Systems;

U.S. Pat. No. 5,252,002 patented Oct. 12, 1993 by J. C. Day;

U.S. Pat. No. 3,749,107 patented Jul. 31, 1973 by N. Laberge;

A problem with constructing exterior walls using such COROPLAST™ panels is that, being thermoplastic, they tend to lose their structural integrity when subjected to heat, e.g., of the sun. This present invention addresses that problem.

In addition, there are many patents that describe Nissen-like building structures. Some of these patents are:

U.S. Pat. No. 6,948,281 patented Sep. 27, 2005 by B. Carmichael;

U.S. Pat. No. 6,679,009 patented Jan. 20, 2004; by D. T. Hotes;

U.S. Pat. No. 6,434,891 patented Aug. 20, 2002 by M. W. Cameron;

U.S. Pat. No. 6,131,343 patented Oct. 17, 2000 by G. L. Williamson;

U.S. Pat. No. 5,611,178 patented Mar. 18, 1997 by Constructions Industrielles de la Mediteranee-CNIM;

U.S. Pat. No. 5,595,203 patented Jan. 21, 1997 by M. A. Espinosa;

U.S. Pat. No. 5,333,421 patented Aug. 2, 1994 by J. T. McKenna;

U.S. Pat. No. 5,252,002 patented Oct. 12, 1993 by J. C. Day;

U.S. Pat. No. 3,749,107 patented Jul. 31, 1973 by N. Laberge;

U.S. Pat. No. 3,629,982 patented Dec. 28, 1971 by The United States of America as represented by the Secretary of the Air Force;

U.S. Pat. No. 970,873 patented Sep. 20, 1910 by C. J. Bear; and

Canadian Patent document No. 2,082,465, published May 10, 1994.

The present invention addresses novel features for incorporation into building structures of this type.

The invention aspires to provide a portable building structure made of modular components that may be easily transported. In particular, it is desirable that all components be of limited length, e.g. for ease of shipping.

The invention in its general form will first be described, and then its implementation in terms of specific embodiments will be detailed with reference to the drawings following hereafter. These embodiments are intended to demonstrate the principle of the invention, and the manner of its implementation. The invention in its broadest sense and more specific forms will then be further described, and defined, in each of the individual claims which conclude this Specification.

SUMMARY OF THE INVENTION

According to one general aspect of the invention, cladding panels are provided which are formed of two sheets of spaced-apart sheeting material united by a plurality of spaced-apart, longitudinally extending webs with intervening channels that are stiffened through the use of reinforcement. As a particular application, such panels may be incorporated into a Nissen-hut like building structure. The building structure of the invention is of a Nissen-hut like form, which may optionally include features to readily incorporate panels according to the invention as well as other forms of paneling.

The Building Structure

According to this latter aspect of the present invention, a building structure is provided which includes a framework, having a plurality of longitudinally spaced-apart arches. Adjacent arches are typically equally spaced along the length of the structure.

All longitudinal component members of the frame are preferably made from tubing although a rod-like form would be permissible. Reference as made herein to tubing also includes rod-like structures and vice versa. Tubing advantageously may have flattened ends that are offset and perforated to receive fasteners to effect connections between frame members.

The building structure includes a longitudinal tubular member, preferably made in segments, that extends down the length of the entire building along the top of each of the arches to serve as a ridgepole. Such ridgepole is coupled to the center of the upper member of each arch to provide structural rigidity. The top of each arch is supported by a transverse truss having two lateral truss ends. Diagonal bracing is preferably incorporated at the ends of the building structure and may also be provided along the sides to provide improved stability.

Each truss includes one or more upper, outer arced tube-like members and one or more lower arced tube-like members. The upper and lower arcs of each truss may be formed of a single arched piece of tubing; but each of these components is preferably divided into two parts to provide symmetrical arc portions and to shorten the length of the components when separated to within a suitable limit e.g. 8 feet or 2.5 meters.

The lower arc of the truss is also an upwardly curved member that extends between the two truss-ends but which has a curvature that is less than the curvature of the upper arch portion to provide a web opening between such components.

The upper and lower arced tubing ends are connected together at their outermost extremities, at the two respective truss-ends, with a truss end bracket. This truss end bracket preferably has a U-shaped cross-sectional profile with a straight, cupped central strip as the bottom of the "U" and two short, preferably flat side flanges. The central strip and side flanges are dimensioned to allow the ends of the two arch members to nest between such flanges in contact with the side flanges and be fixed therein by fasteners such as bolts.

The upper arced tubing portions are joined along the highest point of the arch by a bent plate in the form of a "U"-shaped top-arch bracket that receives the upper ends of the curved top members of the truss. Again, fasteners retain such ends in place within this bracket.

The truss includes a "V"-shaped web member that is symmetrically mounted on the lower curved, bottom member of the truss at its center point. Such "V"-shaped web member extends upwardly and outwardly from such center point of the lower arced member, across the web opening to connect with the upper arch member at two locations which are located symmetrically on either side of the mid-point of the upper arch member. A transversely mounted "U"-shaped web bracket embraces the lower arced member of the truss at the bottom of the "V" at the midpoint. This bracket has upwardly extending flange-like wings that are fastened to the "V"-shaped web member on either side of its lower apex. This bracket is also fastened to the central ends of the lower arch member portions. Preferably, the "V"-shaped web member is formed of a single piece of tubing that is bent at its bottom, central, apex and which apex is contained within the "U"-shaped web bracket and held there by fasteners.

Each arch is provided with two generally upright, inwardly curved, side members that extend upwardly from the ground to terminate at the outermost ends of the truss. At their uppermost ends the side members are coupled to the truss ends by extending into the truss-end brackets where there are fastened in place. Each of these sidewall members is slightly curved so as to be outwardly convex for reasons that will be apparent hereafter. The curvatures for the sidewall members and for the upper arced members of each of the trusses do not share a common center of curvature as in a classic Nissen hut nor need they have similar curvatures. The outer lateral and top-side principal boundaries of the frame nevertheless generally consist entirely of curved members.

A mid-wall horizontal member extends longitudinally down both sides of the building structure at or near the height of the truss-end brackets, generally parallel to the ridgepole. Conveniently, such mid-wall longitudinal members may have flattened ends that are fitted into openings in the truss-end brackets for attachment to the arches. Such mid-wall longitudinal members provide a longitudinally extending stabilizing rail on each respective side of the building structure. This mid-wall member is preferably segmented for ease of shipping, and limited to not exceed a pre-determined length, e.g. 8 feet or 2.5 meters.

The structure includes a base member, preferably tubular and preferably segmented, extending longitudinally for the length of the building on either side of such building positioned beneath or adjacent to each of the side members whereby it is attached to the lower ends of the arches. In a preferred design the side members are seated on or over the base member. At the front and at the back of the building structure, this base member extends transversely, holding the end arches from spreading and thereby providing a complete perimeter base member.

Features to Accommodate Cladding

The walls of the building structure are provided with cladding in the form of a plurality of panels of a width equal to the distance separating the arches, each panel being fitted between adjacent arches on both sides of the structure. Further, panels are used to fill the spaces between the upper truss portions of the arches. The lower edge of each of the panels used as sidewalls is seated into a fitting provided next to the perimeter base member, now described.

A bottom channel member, with the cross-sectional profile of an upwardly open "U", extends longitudinally between arches in segments or continuously, for the length of the building along the outer side of the each of the tubular base members. This bottom channel receives the lower edge of each panel. Such bottom channel members may be segmented to fit between the side members of each of the arches and/or to limit their length. Alternately, if the side members of each of the arches rests on the base member, then the bottom channel member may be positioned outwardly from both of these components as a preferred variant. Such bottom channel members are so dimensioned and oriented as to receive the bottom edges of cladding panels. They are also provided with drain holes to allow water to escape.

In order to receive and support the upper ends of sidewall cladding paneling, a longitudinally extending generally S-profile channel system extends respectively down the two sides of the building. This S-profile channel system is mounted at the height of the mid-wall longitudinal member, being secured to the mid-wall longitudinal members that are present along both sides of the arches. The outer portion of each S-profile channel is upwardly open; and the inner portion of each S-profile channel forms a downwardly open channel, to respectively receive the horizontal edges of cladding panels. The inner, curved, portion of each S-profile channel effectively "hangs" on the mid-wall longitudinal member. Such curved portion may be fastened to the mid-wall longitudinal member to limit its rotation.

The inner portion of the "S" channel has a downwardly open portion defining a downwardly directed, inverted "U"-shaped channel portion adjacent to the curved portion that extends partially around and removably clasps itself to the mid-wall longitudinal member. Such inner side is either interrupted at intervals corresponding with the presence of the tubular arches such that the "S" may interfit around such arches; or the "S" channel is divided up into segments that extend between arches while grasping the mid-wall member. While it would be permissible for this mid-wall channel member to be made of one piece for the full length of the structure, shipping convenience makes it preferable that this channel, as with other longitudinal members, be assembled in segments, preferably spanning between the arches of the structure.

The upper edge of each sidewall cladding panel is to be seated into the inner, downwardly open, "U"-shaped channel portion of the S-profile channel, adjacent and outboard to the mid-wall longitudinal member. Each inverted "U"-shaped channel portion is oriented to retain the cladding panel against, or in close proximity to, the framing of the building structure. A longitudinal gasket strip may be fitted in between the paneling and the S-profile channel to provide a seal against weather and insects.

The sidewall panels are curved to follow almost precisely the curvature of the upright members. The sidewall panels extend between adjacent arches. The vertical edges of each panel are contained by fittings, described further below, carried by each of the upright members. The fitting of the panels within their confining boundaries contributes to the general rigidity of the building structure. Optional additional angular bracing may also be provided.

The "S" channel also provides an upwardly-open, mid-height channel to receive the bottom ends of the roof cladding panels that are to extend over the upper arched portions of the shelter to serve as the roofing surface. By such construction, the upper roofing panels rest seated in the upwardly-open "U"-shaped outer channel of the "S" channel.

To provide this upwardly open "U"-shaped outer channel, a central mid-portion of the "S"-profile channel extends outwardly from the inner side of the "S" channel and outwardly from the mid-wall longitudinal member. Such mid-portion extends downwardly and then bends upwardly to provide the upwardly directed longitudinal "U"-shaped lower channel. This upwardly directed longitudinal "U"-shaped lower channel receives the lower ends of roof cladding panels that are to be seated in the lower channel.

Wall Cladding Panels

Preferably, each of the wall cladding panels is constructed from first and second, inner and outer sheets of synthetic plastic material that are spaced apart at a fixed and generally constant distance from each other by a plurality of spaced-apart webs. These webs provide a series of substantially parallel, hollow tubular channels there between. The sheets and webs may be made of the same synthetic plastic material which either is intrinsically resistant to the weather and environment or has been treated to resist the damaging effects of weather and other environmental conditions, e.g. rain and sunshine etc.

To provide improved structural rigidity, one or more longitudinally extending reinforcing members are disposed within a selected number of the series of the longitudinally extending, hollow channels within each panel, e.g. two. Thus these reinforcing members are confined laterally within and extend along corresponding tubular passageways within the panel. These reinforcing members are sufficiently flexible to bend with the bending of the panels, while being sufficiently rigid to impart stiffness to such panels when in a curved condition. Such members act as battens to provide a stiffening effect to the panels when curved.

Panels as described may be used to provide not only sidewalls for the building structure but also for the roof and front and rear walls. When used for such end walls, in order to allow for panels of shorter length to extend to the full height of the ridgepole, they may be divided into two portions. These portions are joined along the edges wherein the lower edge of the upper portion has been "scarfed" by removing all but the outside surface of the panel adjacent to its lower edge. Pins dimensioned to fit tightly into the channels within the panel may then be inserted at intervals along the respective panel edges to be joined. The overlapping outer layer of the upper panel at the seam serves as a weather seal.

As preferred features, the material of the panels of the present invention may be based on a thermoplastic material such as polyethylene, high-density polyethylene or polypropylene treated to be light/ultraviolet radiation resistant. The reinforcing member may be formed of a polymeric material such as polycarbonate, polymer reinforced glass fibers, steel or aluminum, amongst other materials. Such reinforcing rods may be pultruded rods and may be either solid or hollow.

Preferably, the reinforcing rods are disposed at equal intervals across the range of available hollow channels, although this is not essential.

Roof Ridge Line

As indicated previously, the building structure includes a central longitudinal tubular member that extends centrally down the length of the entire building at the top of each of the arches to serve as a ridgepole. Such ridgepole is coupled to the ends of the two respective upper arced members of each arch by a gable bracket. This gable bracket is preferably in a form which provides a pair of opposed, outwardly extending "U" shaped recesses. The sides of these recesses may be compositely formed and may include outwardly extending flanges that are connected to the centrally located ends of the upper arced members of the arch. As the central ridgepole member runs the length of the shelter along the top of the arches, the gable bracket is shaped to allow the ridgepole member to pass through such bracket. The ridgepole may be unitary but is preferably segmented into intermitting pieces, as with the longitudinal side members, for convenience of shipping.

The ridgepole carries the gable bracket, preferably in the form of a ridgeline bracket assembly that serves to receive the upper ends of the roof cladding panels and to provide a generally weatherproof closure for the top seam of the building structure along the ridge of its roofline.

The composite ridgeline bracket assembly may include a first ridgeline channel component with the general cross-sectional shape of an inverted triangle that has an open bottom in place of the normal, lower, triangle apex. The first ridgeline channel component embraces the ridgepole with a grasping engagement through this open bottom. This component also has an upper horizontal portion that serves as one side of an outwardly extending flange to provide a horizontal surface to receive the upper ends of the roofing panels.

The first ridgeline channel component preferably has a "U"-shaped central channel formed therein along its topside surface, overlying and contacting the ridgepole member grasped within such channel.

The ridgeline bracket assembly further includes a second ridgeline channel component having a downwardly extending "U"-shaped rail that inter-fits with the "U"-shaped central channel. The second ridgeline channel component also has two lateral, horizontally extending, flanges that are dimensioned and positioned to over-lie the upper surface of the upper ends of the roofing panels. By such structure, the upper panel ends are contained on both sides respectively by portions of the first and second ridgeline channel components.

The ridgeline bracket assembly may include a ridge-capping plate, overlying and fastened to the second ridgeline channel component. This plate is preferably be made in segmented sections that overlap. Linear sealing strips are positioned along the underside of the outer edges of the ridgeplate to limit entry of the elements into the shelter. Rivet nuts may be fastened to this overlying plate at intervals, extending downwardly through holes formed in the first and second ridgeline channel components and the ridgepole itself to receive a threaded faster, e.g. a screw, inserted upwardly from beneath the ridgepole. In this manner the ridgeline bracket assembly is both held together and attached to the ridgepole.

Optionally, a pair of upwardly erupted longitudinally extending ridges is formed in the second ridgeline channel component near or at the point of juncture between the two horizontally extending flanges and the upper ends of the "U"-shaped channel. These two ridges serve to provide both support for the ridge-capping plate and to act as an additional barrier for the entry into the shelter of water that may manage to penetrate under the ridge-capping plate.

Vertical Edge Treatment of Panels

The panel cladding along the sides and roof of the structure is divided into multiple individual panels with abutting or nearly abutting vertical seams that align with the arch sidewall members. Such seams may be held in place and sealed against the elements by an overlying strapping, preferably corrugated, that is curved to match the curvature of the panels and fastened to the arch members along the lines where the panel edges abut each other. This structure serves to constrain the frame elements to remain in a rectilinear alignment with each other as well as provide a seal for the inter-panel seams.

Such strapping may be provided with three outwardly directed, flattened and extended wave crests. When viewed in cross-section, the central flattened wave crest is positioned to overlie the abutting edges of the panels and to receive the fasteners connecting it to the curved outer members of the arches. The remaining two lateral flattened wave crests may contain linear gaskets which are compressed against the panels' surfaces to provide a seal against the environment and help to fix the abutting panels in position. Similar curved strapping extending upwardly and along both the sides and tops of the arches confining the edges of both the side and roof cladding panels.

The last pieces of strapping extending along the arches at the respective ends of the building structure may include an additional flange that is bent around the corner of the arches to overlie the end faces of such arches. This provides both an aesthetic appearance and serves to contain wall paneling used to close off the end of the building structure.

The arches are also provided with a seating member for the inner faces of the panel edges, the sealing member being fastened along the outwardly directed portions of the arches. The seating member may be in the form of a flat, central strip having two short, inwardly-directed side flanges, the central strip and side flanges being dimensioned to allow an arch member to nest between such flanges in contact with the central strip and the edges of the flanges. The flat outer surface of the seating member bears against and supports the inner face surfaces of the panels along vertical edges of the cladding panels.

Further Optional Features

As a further optional feature, the structure may be provided with a tarpaulin-type floor covering which is anchored in place along the tubular base member on the inner side of the building by means of a curved retainer plate. This curved retainer plate is adjustably connected to and positioned over the base member with the edge of the floor covering contained there between. A flange may be formed on the retainer plate to allow such plate to be fastened to the lower portions of the upright tubular members of each arch.

The end panels of the building may be provided with a louver mounted in an upper portion in order to permit air to enter and freshen the interior. This louver may be press-fitted into an opening cut in an end panel. Rotating fingers along the inner edges of the louver may then be oriented to overlie the inside surface of the end panel into which the louver is fitted. This retains the louver in place.

The louver may also be provided with a closure plate which fits into the louver on it's inside face. The same rotatable fingers may be positioned to overlie this plate, once in position, and retain it in place. As a particular feature relating to the rotatable fingers, such fingers may be a-symmetrical about its center of rotation, being wider on one side than on the other. In this manner, the narrower side of each finger may be aligned with the edge of the opening cut to receive the louver, permitting the louver to be removed from, or inserted into, the opening in the end wall. The wider side of each finger can optionally be positioned to overlie the edge of the panel opening retaining the louver in place while a closure plate is applied over the louver. Rotation of such fingers by 90° to lie transversely across the edge of the panel opening and the louver will lock the closure plate in place on the louver and the louver in place on the wall.

Windows may be fitted into openings in the sidewalls, particularly the end walls of the building structure. When the end walls are formed of the special reinforce panels of the invention, the reinforcing rods within such panels are positioned to be in-register with the periphery of the window frame. This provides improved structural integrity for the alignment and retention of the window frame within its opening in the building walls.

On this basis, a new in useful structure has been described that is both portable and suitable for ready or action on a remote site. While light, the building structure is sturdy and durable and provides a relatively improved degree of shelter against the elements. By limiting the dimensions of individual elements, a shipping package can be assembled which is particularly convenient to handle. Specifically, the shipping package can be limited to dimensions that can be easily fitted within a standard industrial container.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
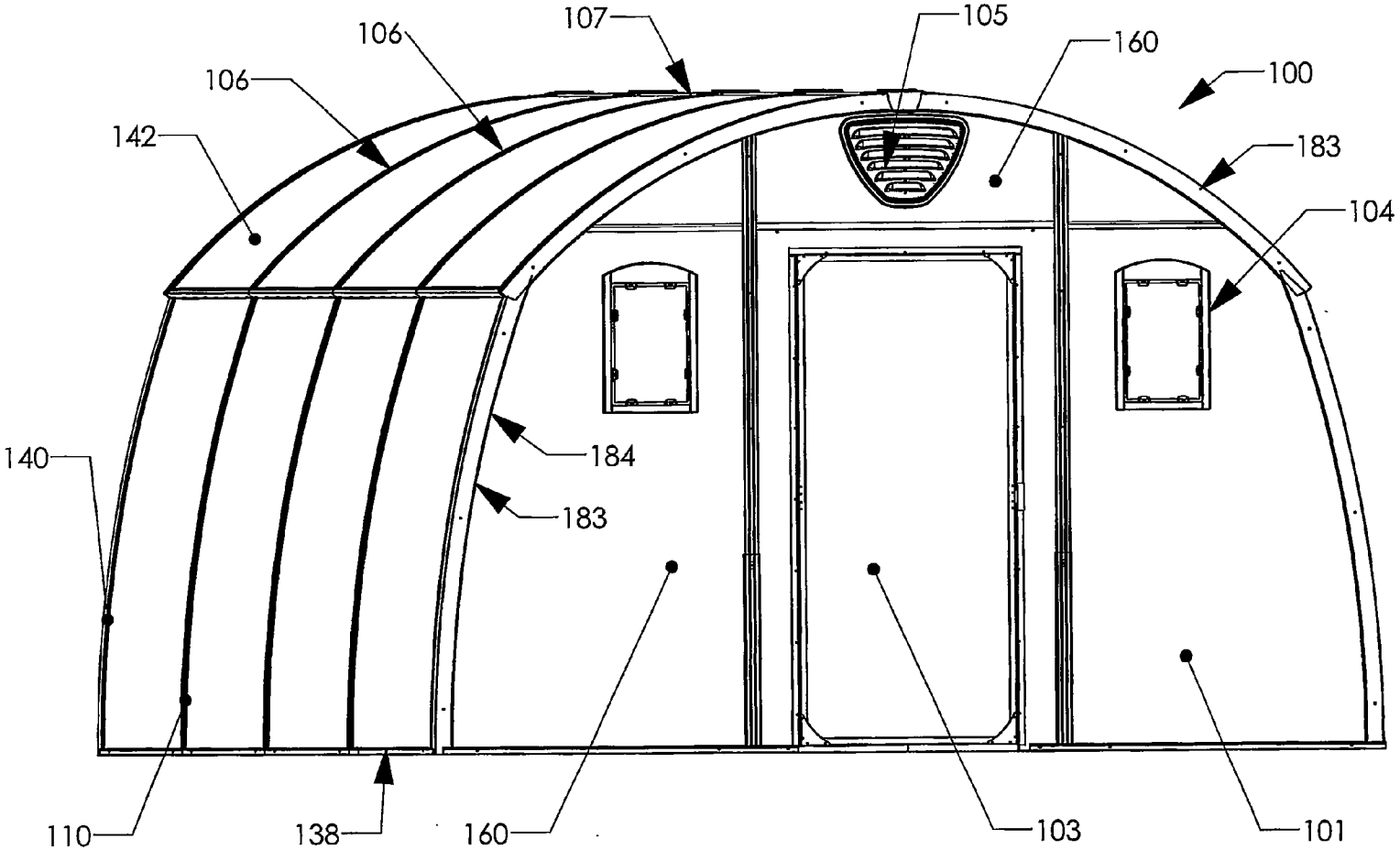
FIG. 1 is an exterior, perspective, front-side view of a Nissen hut like structure according to one aspect of the present invention, showing a door, two windows and a ventilation louver.
Figure 2:
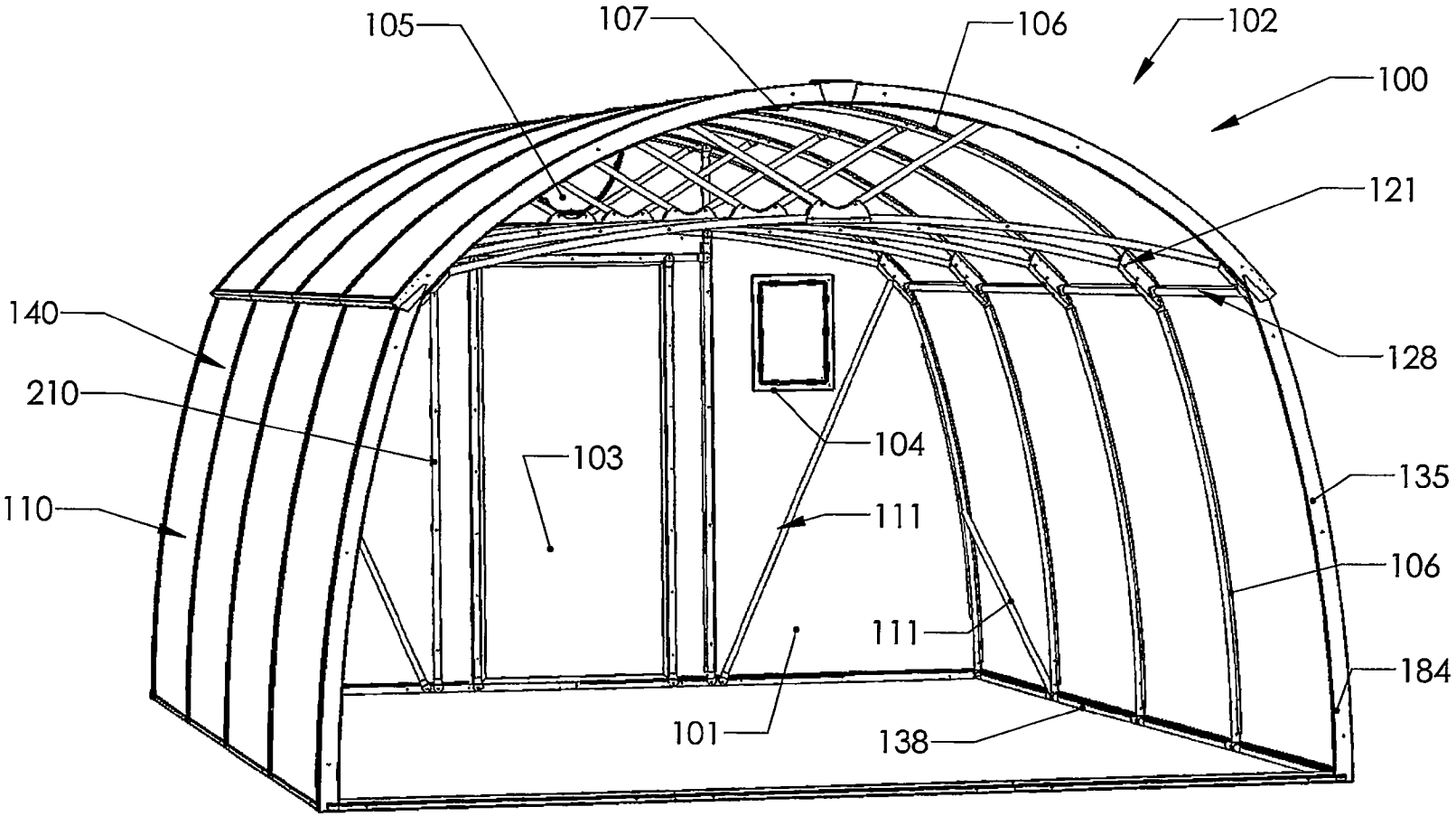
FIG. 2 is a rear perspective view of the hut like structure of FIG. 1 with the rear wall removed to show the arches and framing and showing the interior sides of the door, two windows and ventilation louver with a closure plate over the louver.

As seen in FIG. 1 and FIG. 2, the hut-like building structure 100 includes a front wall 101 and a rear wall (not seen). The front wall 101 includes a door 103 and window structures 104, the details of construction of which will be more fully described with relation to FIG. 10 and FIG. 11. The front wall 101 also includes a vent structure 105, the details of construction of which will be more fully described with relation to FIG. 10A-FIG. 10B.

The building structure 100 includes a framework 102 having a plurality of longitudinally spaced-apart arches 106. Adjacent arches 106 are typically equally spaced along the length of the structure 100.

All longitudinal component members of the frame 102 as shown in FIG. 2 are preferably made from tubing or rod which may have flattened ends that may be either centrally aligned or offset with holes in the flattened ends to receive fasteners to effect connections between frame members.

A main longitudinal tubular member or ridgepole 107, preferably made in segments extends down the length of the entire building 100 along the top of each of the arches 106 to serve as a ridgepole. Such ridgepole 107 is coupled to the center 120 of the upper member 108 of each arch 106 to provide structural rigidity. The top of each arch is supported by a transverse truss 116 having two lateral truss ends 112. Diagonal bracing 111 is preferably incorporated at the front wall end 101 and rear wall end (not shown) of the building structure 100 and may also be provided along the sides 110 to provide improved stability.

Figure 3:
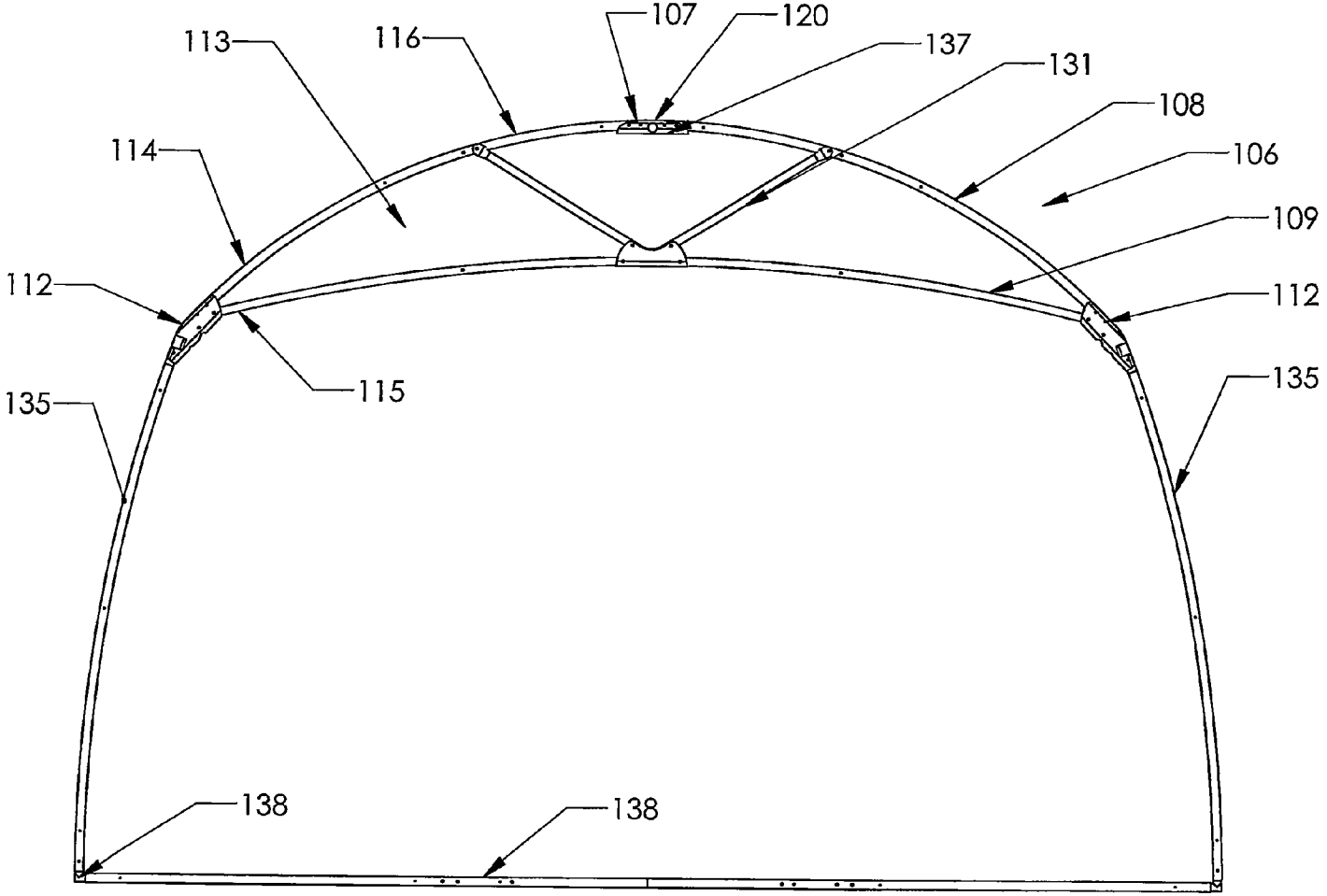
FIG. 3 is a front-end view of the principal arch of the structure of FIG. 1.
Figures 4, 4A, 4B, 4C, 4D:
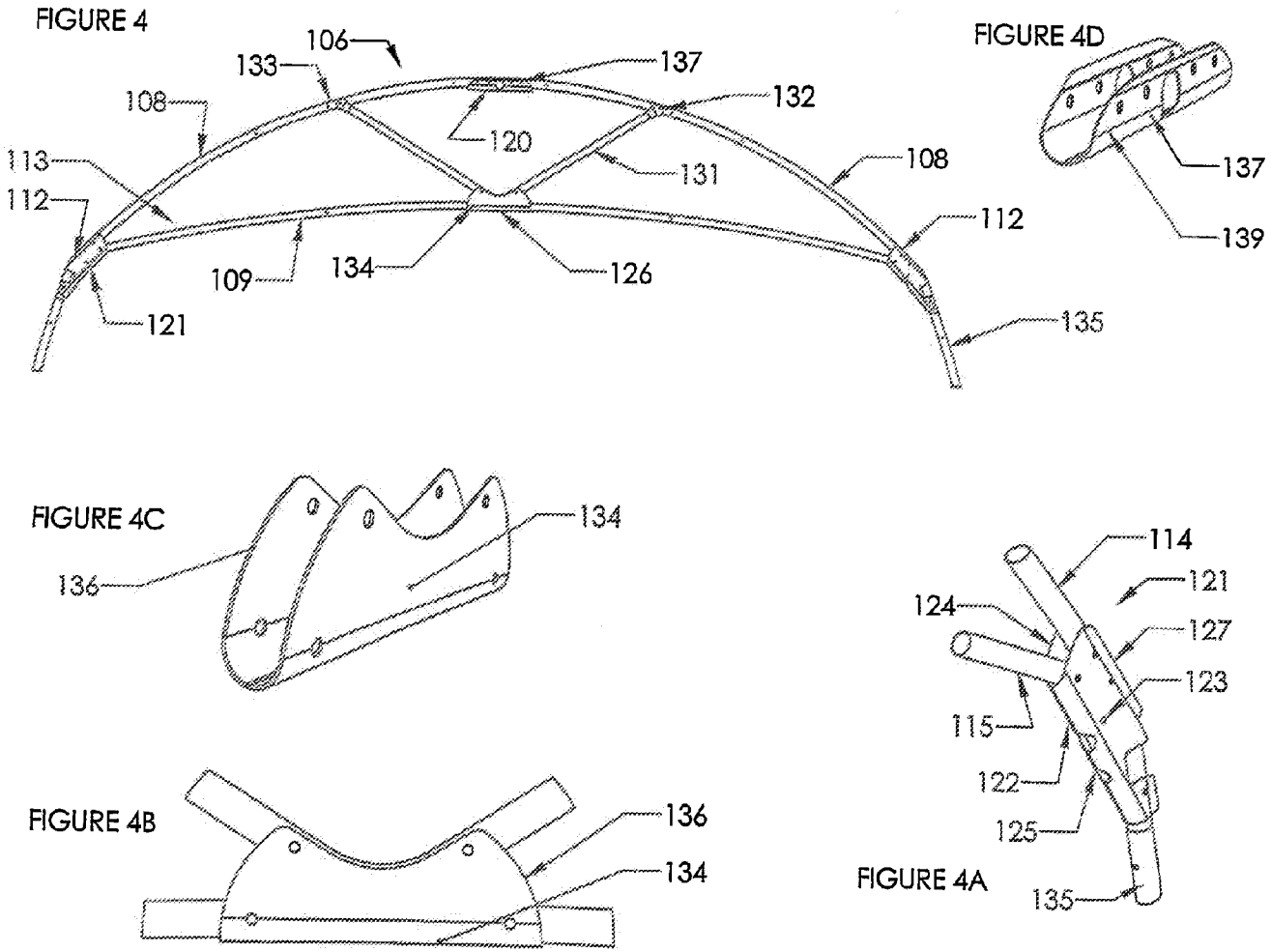
FIG. 4 is a face elevation view of a truss forming part of an arch in the hut like structure of FIG. 1 having upper and lower arced portions.
FIG. 4A is a perspective view of a truss end bracket engaged with tubular members.
FIGS. 4B and 4C are respectively face and perspective views of the V-truss bracket located at the center of the lower arced member.
FIG. 4D is a perspective view of the ridgeline joining bracket joining the upper portions of the upper arced member along the roof centerline.

The top portion of each arch 106 is maintained structurally rigid by a truss 116 as shown in FIGS. 3 and 4. Each truss 116 is defined by one or more upper, outer arced tube-like members 108 which are part of the arch 106, and one or more lower arced tube-like members 109. The upper and lower arced members 108, 109 of each truss 116 are preferably formed of arched tubing divided into two parts to provide symmetrical arc portions of a preferred length e.g. 8 feet or 2.5 meters. The central ends of these parts may be joined by a top, arch-joining bracket 137. The lower arc 109 of the arch 106 is also an upwardly curved member, preferably divided into two or more shorter components, that extends between the two truss-ends 112 but which has a curvature which has a radius of curvature (but not necessarily concentric) that is less than the curvature of the upper arch portion 108 to provide a web opening 113 between such components.

The upper and lower arced tubing ends 114, 115 are connected together at their outermost extremities, at the two respective truss-ends 112, with a truss end bracket 121. This truss end bracket 121 preferably has a U-shaped cross-sectional profile with a central joining strip 122 as the bottom of the "U" and two short, side flanges 123, 124. The central strip 122 and side flanges 123, 124 are dimensioned to allow the two ends 114, 115 of the arch members 108, 109 to nest between such flanges 123, 124 in contact with the side flanges 123, 124 and be fixed therein by fasteners such as bolts. A square notch 127 may be formed in the side flanges 123, 124 to allow for penetration of the ends of the longitudinal member 128 for coupling to the side member 135. Access openings 125 may also be formed in the central strip 122 of the truss end bracket 121 to permit access to fasteners.

The upper arced tubing portions 108 are joined along the highest point 120 of the arch 106 by a bent plate in the form of a "U"-shaped top-arch bracket 137 that receives the upper ends of the curved top members 108 of the arch 106. Again, fasteners retain such ends in place within this bracket 137.

The arch 106 includes a "V"-shaped web member 131 as shown in FIG. 4 that is symmetrically mounted on the lower curved, bottom member 109 of the arch 106 at its center point 126. Such "V"-shaped web member 131 extends upwardly and outwardly from such center point 126 of the lower arced member 109, across the web opening 113 to connect with the upper arch 108 member at two locations 132, 133 which are located symmetrically on either side of the mid-point 120 of the upper arch member 108. A transversely mounted "U"-shaped web bracket 134 embraces the lower arced members 109 of the truss 116 at the bottom of the "V" at the midpoint. This bracket 134 has upwardly extending flange-like wings 136 that are fastened to the "V"-shaped web member 131 on either side of its lower apex. This bracket 134 is also fastened to the central ends of the lower arch 109 member portions. Preferably, the "V"-shaped web member 131 is formed of a single piece of tubing that is bent at its bottom, central, apex and which apex is contained within the "U"-shaped web bracket 134 and held there by fasteners.

Each arch 106 as shown in FIG. 3 is provided with two generally upright, inwardly curved, side members 135 that extend upwardly from the ground to terminate at the outermost ends of the truss 116. At their uppermost ends the side members 135 are coupled to the truss ends 112 by extending into the truss-end brackets 121 where they are fastened in place. Each of these sidewall members 135 is slightly curved so as to be outwardly convex. The curvatures for the sidewall members 135 and for the upper arced members 108 of each of the trusses 116 do not share a common center of curvature nor even necessarily, the same curvature as would be found in a classic Nissen hut. The outer lateral and topside boundaries of the frame 102 nevertheless consist entirely of curved members.

A mid-wall horizontal longitudinal member 128 extends longitudinally down both sides of the building structure 100 at the height of the truss-end brackets 121, generally parallel to the ridgepole 107. Conveniently, such mid-wall longitudinal member 128 may have flattened ends which are fitted into to the truss-end brackets 121 through the notches 127 for attachment to the arches 106 and thereby provide a longitudinally-extending stabilizing rail on each respective side of the building structure 100. This mid-wall member 128 is preferably segmented for ease of shipping, and limited to the preferred length, e.g. 8 feet or 2.5 meters.

Figures 5, 5A, 5B:
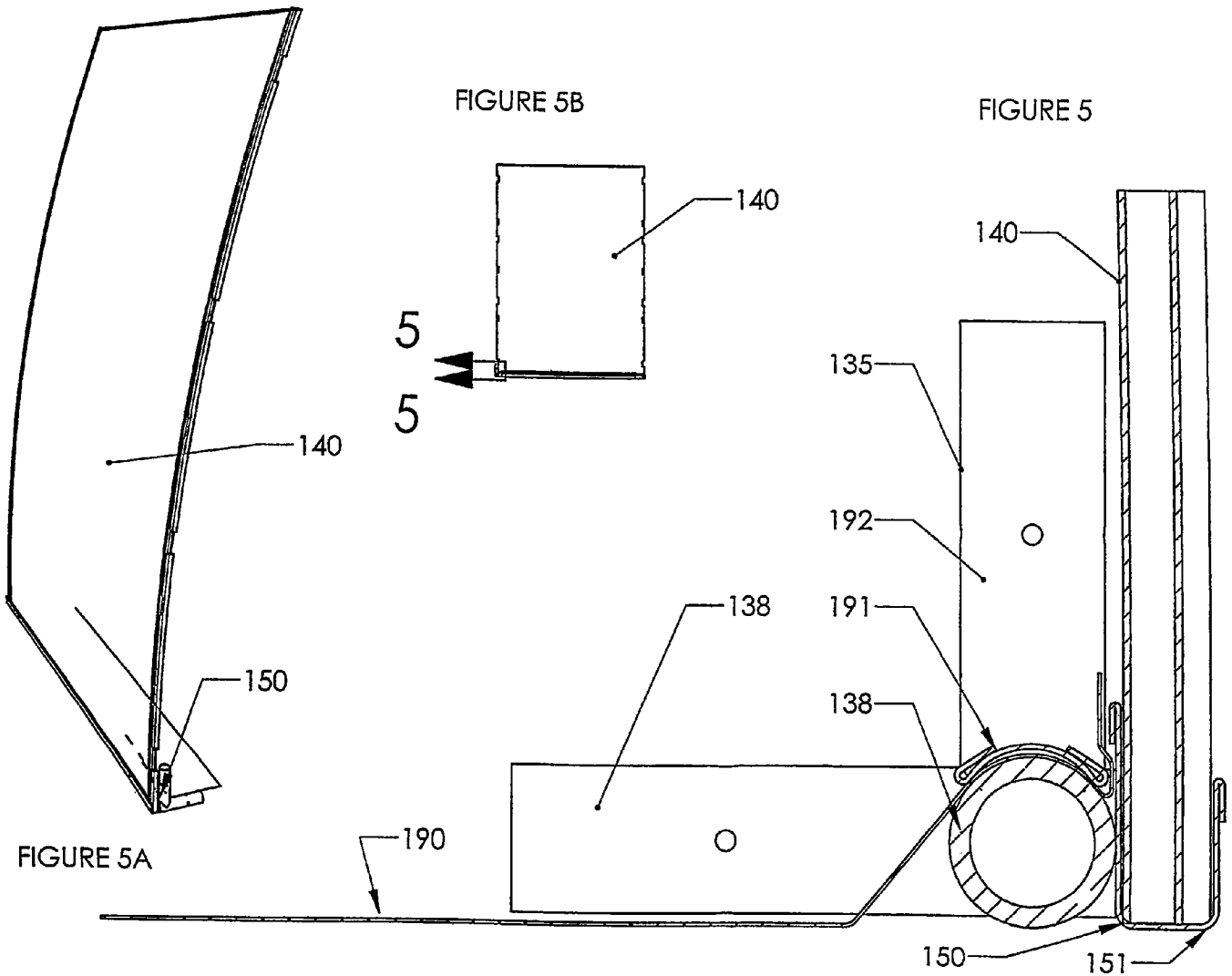
FIG. 5 is a cross-sectional view of a base member and base channel of the hut-like structure of FIG. 1.
FIG. 5A is a perspective view of the sidewall panel mounted in the base channel of FIG. 5.
FIG. 5B is a face view of the panel of FIG. 5A mounted in the base channel showing the direction of the cross-section of FIG. 5.

As shown in FIG. 5, the structure 100 includes a base member 138, preferably tubular and preferably segmented, extending longitudinally for the length of the building 100 on either side of such building 100 positioned beneath or adjacent to each of the side members 135 whereby it is attached to the lower ends of the arches 106. In a preferred embodiment the side members 135 are seated on or over the base member 138. At the front 101 and at the back (not shown) of the building structure, this base member 138 extends transversely, holding the bottom of the end arches 106 from spreading and thereby providing a complete perimeter base member.

The walls of the building structure 100 are provided with cladding in the form of a plurality of panels 140 of a width equal to the distance separating adjacent arches 106, each panel 140 being fitted to span the space between adjacent arches 106 on both sides of the structure. Further, panels 140 are used to fill the spaces between the upper arch members 108 of the arches 106. The lower edge of each of the panels 140 used as sidewalls is seated into a fitting 150 provided next to the perimeter base member 138, now described.

A bottom channel member 150, with the cross-sectional profile of an upwardly-open "U", extends longitudinally between arches 106 in segments or continuously, for the length of the building 100 along the outer side of the each of the tubular base members 138. This bottom channel 150 receives the lower edge of each panel 140. Such bottom channel members 150 may be segmented to span between the side members 135 of each of the arches 106 and/or to limit their length. Alternately, if the side members 135 of each of the arches 106 rests on the base member 138, then the bottom channel member 150 may be positioned outwardly from both of these components is a preferred variant. Such bottom channel members 150 are so dimensioned and oriented as to receive the bottom edges of cladding panels 140. They are preferably also provided with drain holes 151 to allow water to escape.

Figure 6:
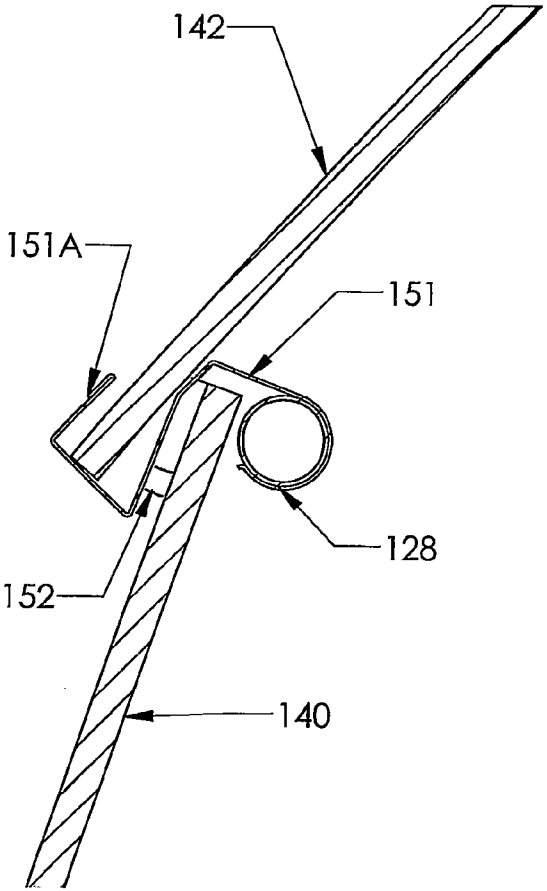
FIG. 6 is a side cross-sectional view of an "S"-profile channel receiving the edges of upper and lower cladding panels.
Figure 6A:
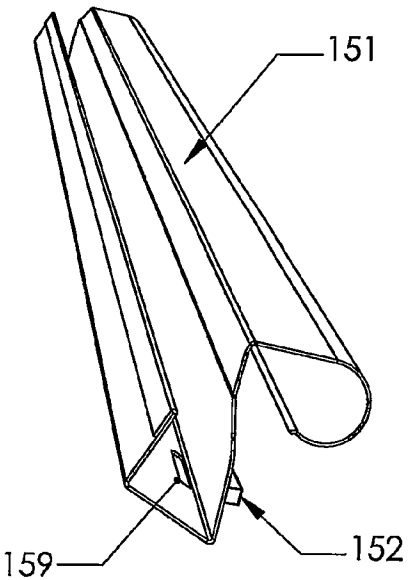
FIG. 6A is a perspective view of the "S" channel of FIG. 6.
Figure 6B:
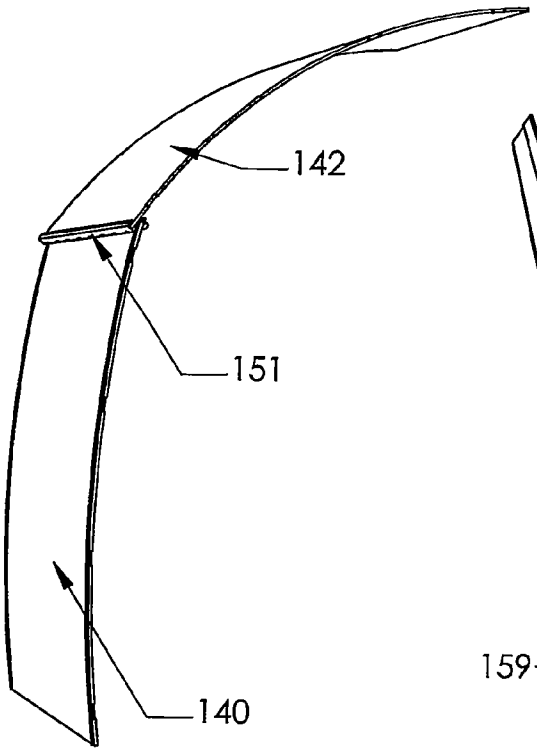
FIG. 6B is a perspective view of the assembly of the two cladding panels that are fitted into the "S" channel.

In order to receive and support the upper ends of sidewall cladding paneling 140, a longitudinally extending generally S-profile channel 151 system as shown in FIG. 6 extends respectively down the two sides of the building 100. This S-profile channel system is mounted at the height of the mid-wall longitudinal members 128, being secured to the mid-wall longitudinal members 128 that are present along both sides of the arches 106 so as to extend outwardly therefrom. The outer portion of each S-profile channel 151 is upwardly open; and an inner portion of each S-profile channel 151 is downwardly open. A further inner portion of each S-profile channel 151 effectively "hangs" on the mid-wall longitudinal member 128.

The inner portion of the "S" channel 151 is, in part, shaped to define a cupping "U"-shaped channel that extends partially around and removably clasps itself to the mid-wall longitudinal member 128. Such inner side is either interrupted at intervals corresponding with the presence of the tubular arches 106 such that the "S" may interfit around such arches 106; or the "S" channel 151 is divided up into segments that extend between arches 106 while grasping the mid-wall member 128. While it would be permissible for this mid-wall channel member 151 to be made of one piece for the full length of the structure, shipping convenience makes it preferable that this channel 151, as with other longitudinal members, be assembled in segments, preferably spanning between the arches 106 of the structure 100.

The upper edge of each sidewall cladding panel 140 is to be seated into the inner, downwardly open, "U"-shaped channel portion of the S-profile channel 151, along with and outboard to the mid-wall longitudinal member 128. Each inverted "U"-shaped channel portion is oriented to retain the cladding panel 140 against, or in close proximity to, the framework 102 of the building structure 100. A longitudinal gasket strip 152 may be fitted in between the paneling 140 and the S-profile channel 151 to provide a seal against weather and insects.

The sidewall panels 140 are curved to follow almost precisely the curvature of the upright side members 135. The sidewall panels 140 extend between adjacent arches 106. The vertical edges 141 of each panel 140 are contained by fittings, described further below, carried by each of the upright side members 135. The fitting of the panels 140 within their confining boundaries contributes to the general rigidity of the building structure 100. Optional additional angular bracing 111 may also be provided.

The "S" channel 151 also provides an upwardly-open, mid-height channel to receive the bottom ends of roof cladding panels 142 that are to extend over the upper arched portions of the shelter 100 to serve as the roofing surface. By such construction, the upper roofing panels 142 rest seated in the upwardly open "U"-shaped outer channel of the "S" channel 151.

To provide this upwardly open "U"-shaped outer channel, a central mid-portion of the "S"-profile channel 151 extends outwardly from the inner side of the "S" channel 151 and outwardly from the mid-wall longitudinal member 128. Such mid-portion extends downwardly and then bends upwardly to provide the upwardly directed longitudinal "U"-shaped lower channel 151A. This upwardly directed longitudinal "U"-shaped lower channel 151A receives the lower ends of roof cladding panels 142 which are to be seated in the lower channel.

Figures 7, 7A:
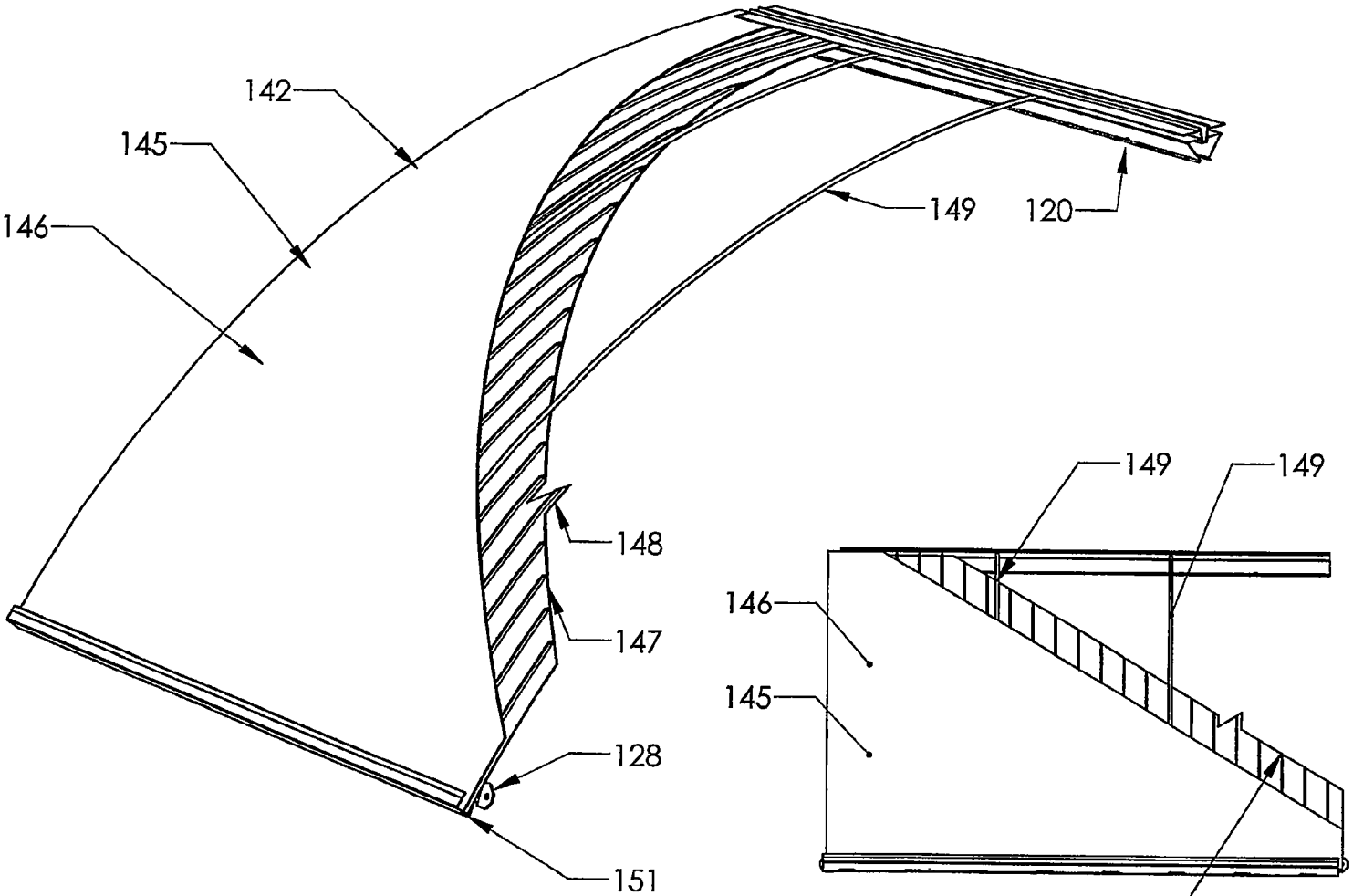
FIG. 7 is a perspective view of a curved cladding panel seated in an "S" channel and extending upwardly into the roof gable assembly.
FIG. 7A is a side elevation view of FIG. 7.
Figure 8:
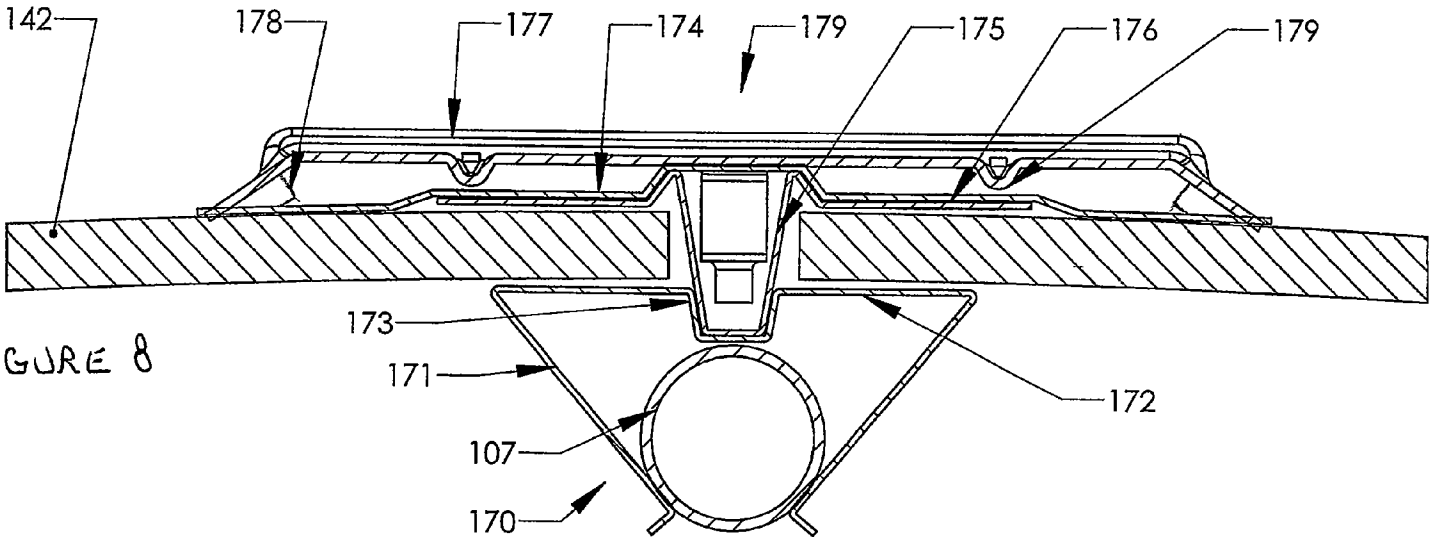
FIG. 8 is a cross-sectional end view through the ridgeline bracket assembly containing the upper ends of two roof-cladding panels.
Figure 8A:
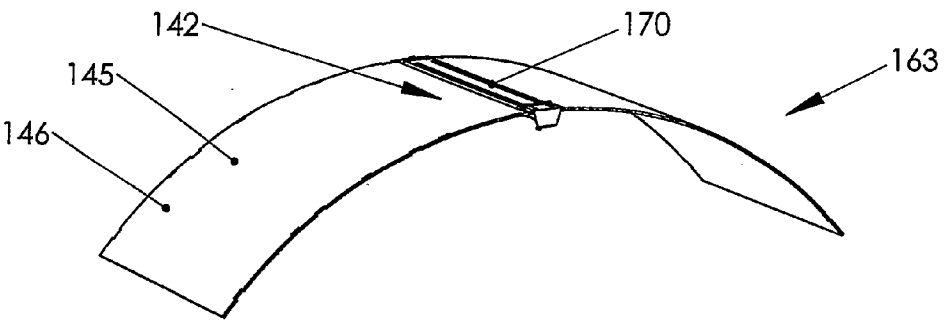
FIG. 8A is a perspective view of two roof cladding panels meeting at the ridgeline bracket assembly of FIG. 8.

The wall of cladding panels 140, 142 may be of any form of sheeting material. Preferably, each of the wall and roof cladding panels is in the form of a composite, reinforced panel 145 as shown in FIG. 7. This panel 145 is constructed from first 146 and second 147, inner and outer sheets of synthetic plastic material that are spaced apart at a fixed and generally constant distance from each other by a plurality of spaced-apart webs 148. These webs 148 provide a series of substantially parallel, hollow tubular channels there between. The sheets 146, 147 and webs 148 may be made of the same synthetic plastic material which either is intrinsically resistant to the weather and environment or has been treated to resist the damaging effects of weather and other environmental conditions, e.g. rain and sunshine etc.

To provide improved structural rigidity, one or more longitudinally extending reinforcing members 149 are disposed within a selected number of the series of the longitudinally extending, hollow channels within each panel, e.g. two. Thus these reinforcing members 149 are confined laterally within and extend along corresponding tubular passageways within the panel 145. These reinforcing members 149 are sufficiently flexible to bend with the bending of the panels 145, while being sufficiently rigid to impart stiffness to such panels 145 when in a curved condition. Such members 149 act as battens to provide a stiffening effect to the panels 145 when curved.

Figure 12B:
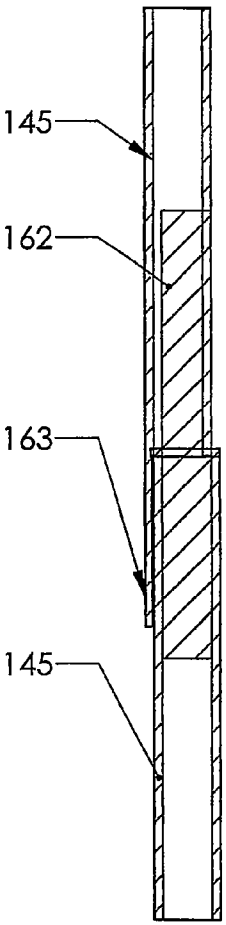
FIG. 12B is a vertical cross-sectional view of the end panels of FIG. 12A along the seam with cross-sectioned pegs present.
Figure 12A:
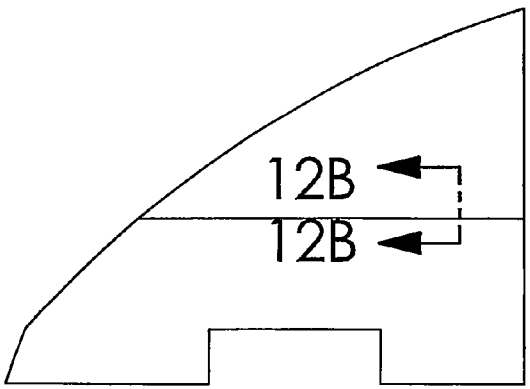
FIG. 12A is a face view of FIG. 12 showing the direction of the cross-section of FIG. 12B.
Figure 12:
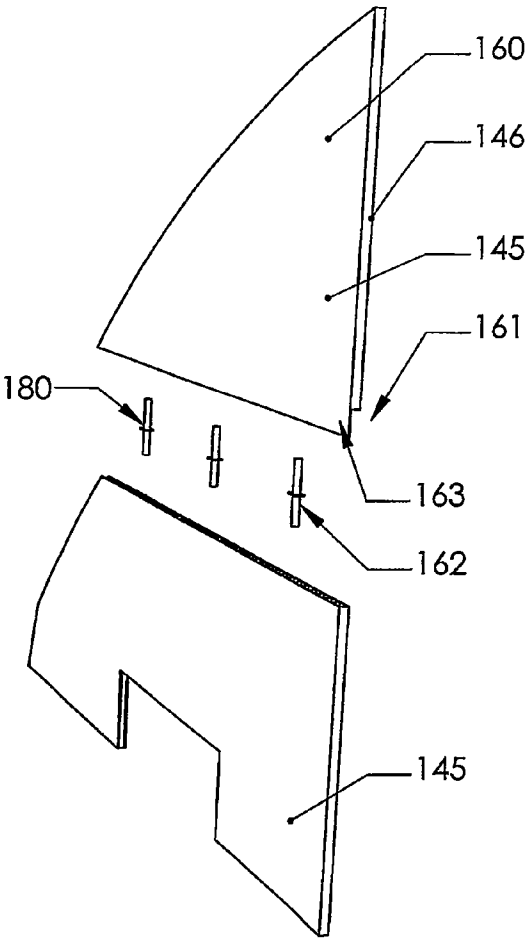
FIG. 12 is an exploded perspective view of two hollow-core vertical end panels for the building structure joined by pegs along a scarfed seam.

Panels 145 as described may be used to provide not only sidewalls 140 for the building structure 100 but also for the roof 163 and front 101 and rear or end walls 160. When used for such end walls 160, in order to allow for panels 145 of shorter length to extend to the full height of the ridgepole 107, they may be divided into two portions as shown in FIGS. 12, and 12A. These portions are joined along the edges wherein the lower edge 161 of the upper portion has been "scarfed" by removing all but the outside surface 146 of the panel 145 adjacent to its lower edge. Pins 162 dimensioned to fit tightly into the channels within the panel 145 may then be inserted at intervals along the respective panel edges to be joined. Such pins may have central collars 180 to limit their penetration. The overlapping outer layer 163 of the upper panel 145 at the seam serves as a weather seal.

As a preferred feature, the material of the panels 145 of the present invention may be based on a thermoplastic material such as polyethylene, high-density polyethylene or polypropylene treated to be light/ultraviolet radiation resistant. The reinforcing member 149 may be formed of a polymeric material such as polycarbonate, polymer reinforced glass fibers, steel or aluminum, amongst other materials. Such reinforcing rods 149 may be pultruded rods and may be either solid or hollow.

Preferably, the reinforcing rods 149 are disposed at equal intervals across the range of available hollow channels, although this is not essential.

As indicated previously, the building structure 100 includes a central longitudinal tubular member 107 that extends centrally down the length of the entire building 100 at the top of each of the arches 106 to serve as a ridgepole 107. Such ridgepole 107 is coupled to the ends of the two respective upper arced members 108 of each arch 106 by a top arch bracket 137 as shown in FIG. 4D. This top arch bracket 137 is preferably in the form of a transversely-extending "U" shape with upwardly extending flanges 139 that are fastened to the centrally-located ends of the upper arced members 108 of the arch 106. As the central ridgepole member 107 runs the length of the shelter 100 along the top of the arches 106, the top arch bracket 137 is shaped with an opening to allow the ridgepole 107 member to pass through or into such bracket 137. The ridge-pole 107 may be unitary but is preferably segmented into interfitting pieces, as with the longitudinal side members 128, for convenience of shipping, and may thereby be connected individually to each of the arches 106 along the center 120 of each arch member 106.

The ridgepole 107 carries a ridgeline bracket assembly 170 that serves to receive the upper ends of the roof cladding panels 142 and to provide a generally weatherproof closure for the top seam of the building structure 100 along the ridge of its roofline.

The ridgeline bracket assembly 170 includes a first ridgeline channel component 171 with the general cross-sectional shape of an inverted triangle that has an open bottom in place of the normal, lower, triangle apex. The first ridgeline channel component 171 embraces the ridgepole 107 with a grasping engagement through this open bottom. This component 171 also has an upper horizontal portion 172 that provides a horizontal surface to receive the upper ends of the roofing panels 142.

The first ridgeline channel component 171 preferably has a "U"-shaped central channel 173 formed therein along its topside surface, overlying and contacting the ridge-pole member 107 grasped within such channel 171. The ridgeline bracket assembly 170 further includes a second ridgeline channel component 174 having a downwardly extending "U"-shaped rail 175 which inter-fits with the "U"-shaped central channel 173. The second ridgeline channel component 174 also has two lateral, horizontally extending, flanges 176 which are dimensioned and positioned to over-lie the upper surface of the upper ends of the roofing panels 142. By such structure, such upper panel ends are contained on both sides respectively by portions of the first and second ridgeline channel components, 171, 172.

The ridgeline bracket assembly 170 includes a ridge-capping plate 177, overlying and fastened to the second ridgeline channel component 174. This plate 177 is preferably made in segmented sections that overlap preferably out-of-step with overlaps in the first ridgeline channel component 171. Linear sealing strips 178 are positioned along the underside of the outer edges of the ridge-plate to limit entry of the elements into the shelter. Rivet nuts may be fastened to this overlying plate 177 at intervals, extending downwardly through holes formed in the first and second ridgeline channel components 171, 174 and the ridgepole 107 themselves to receive a threaded faster, e.g. a screw, inserted upwardly from beneath the ridgepole 107.

Optionally, a pair of upwardly erupted longitudinally extending ridges 179 is formed in the second ridgeline channel 174 component near or at the point of juncture between the two horizontally extending flanges 176 and the upper ends of the "U"-shaped rail 175. These two ridges 179 serve to provide both support for the ridge-capping plate 177 and to act as an additional barrier for the entry into the shelter of water that may manage to penetrate under the ridge-capping plate 177.

Figure 9A:
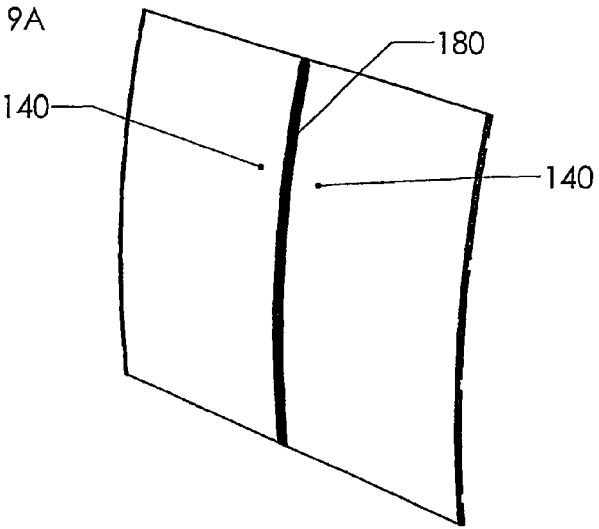
FIG. 9A is a perspective view of the two panels of FIG. 9.
Figure 9:
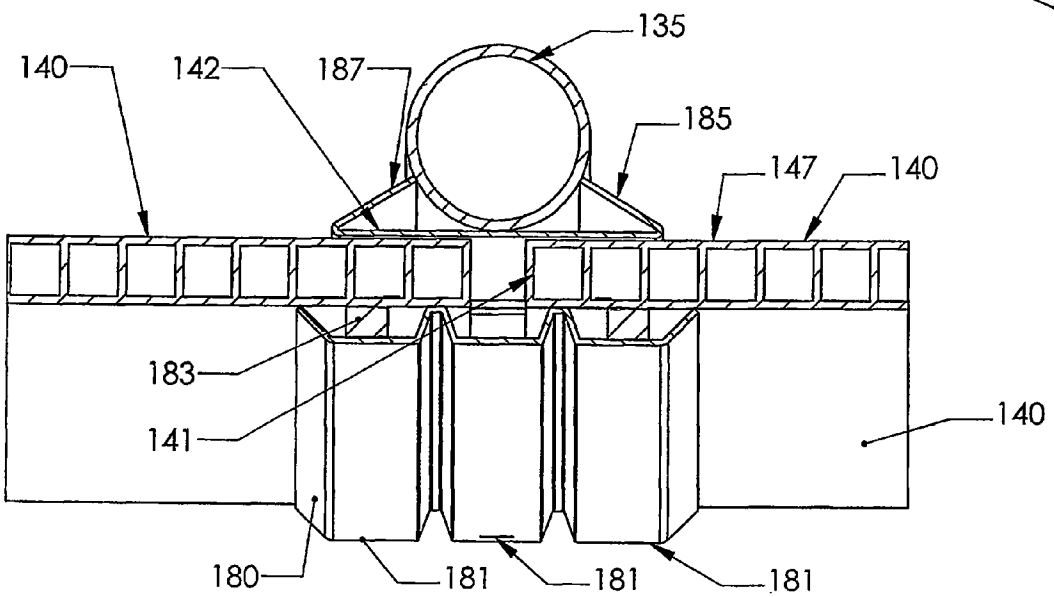
FIG. 9 is a downwardly directed perspective of a cross-section of vertical edges of two sidewall cladding panels meeting beneath a vertical corrugated strap that contains such vertical edges against the side member of an arch.

Turning to FIG. 9, the panel cladding along the sides 110 and roof 163 of the structure 100 is divided into multiple individual panels 140 with abutting vertical edges 141 that align with the arch sidewall members 135. Such panels 140 are held in place and provide a seal against the elements by an overlying corrugated strapping 180 that is curved to match the curvature of the panels 140 and fastened to the arch members 135 along the lines where the panel edges 141 abut or lay in close proximity to each other each other. This structure serves to constrain the frame elements 106 to remain in a rectilinear alignment with each other as well as provide a seal for the inter-panel seams.

Such strapping 180 is preferably provided with three outwardly directed, widened, flat-topped wave crests 181. When viewed in cross-section, the central flat-topped wave crest is positioned to overlie the respective edges 141 of the panels 140 and to receive the fasteners connecting it to the curved outer members 135 of the arches 106. The remaining two lateral wave crests may contain linear gaskets 188 which are compressed against the panels' surfaces to provide a seal against the environment and help to fix the abutting panels 140 in position. Similar curved strapping 180 extends over both the sides and tops of the arches 106 confining the edges 141 of both the side and roof cladding panels 140, 142.

The arches 106 are also provided with a panel seating member 185 also shown in FIG. 9, member 185 being fastened along the outwardly directed portions of the arches 106. The inner seating member 185 may be in the form of a flat, central seating strip 186 having two short, inwardly-directed side flanges 187, the central strip 186 and side flanges 187 being dimensioned to allow an arch 106 member 135 to nest between such flanges 187 in contact with the central strip 186 and the edges of the flanges 187. The flat outer surface of the seating member 186 bears against and supports the inner face surfaces 147 of the panels 140 along vertical edges 141 of the cladding panels 140.

The last pieces of strapping 183 extending along the arches 106 at the respective ends of the building structure 100 may include an additional flange 184 shown in FIGS. 1 and 2 that is bent around the corner of the arches 106 to overlie the end faces of such arches 106. This provides both an aesthetic appearance and serves to contain wall paneling 140 used to close off the end of the building structure 100.

As a further optional feature, the structure 100 may be provided with a tarpaulin-type floor covering 190 as shown in FIG. 5 that is anchored in place along the tubular base member 138 on the inner side of the building by means of a curved retainer plate 191. This curved retainer plate 191, as shown in FIG. 5, is adjustably connected to and positioned over the base member 138 with the edge of the floor covering 190 contained therebetween. A flange 192 may be formed on the retainer plate 191 to allow such plate 191 to be fastened to the lower portions of the upright tubular members 135 of each arch 106.

Figure 10:
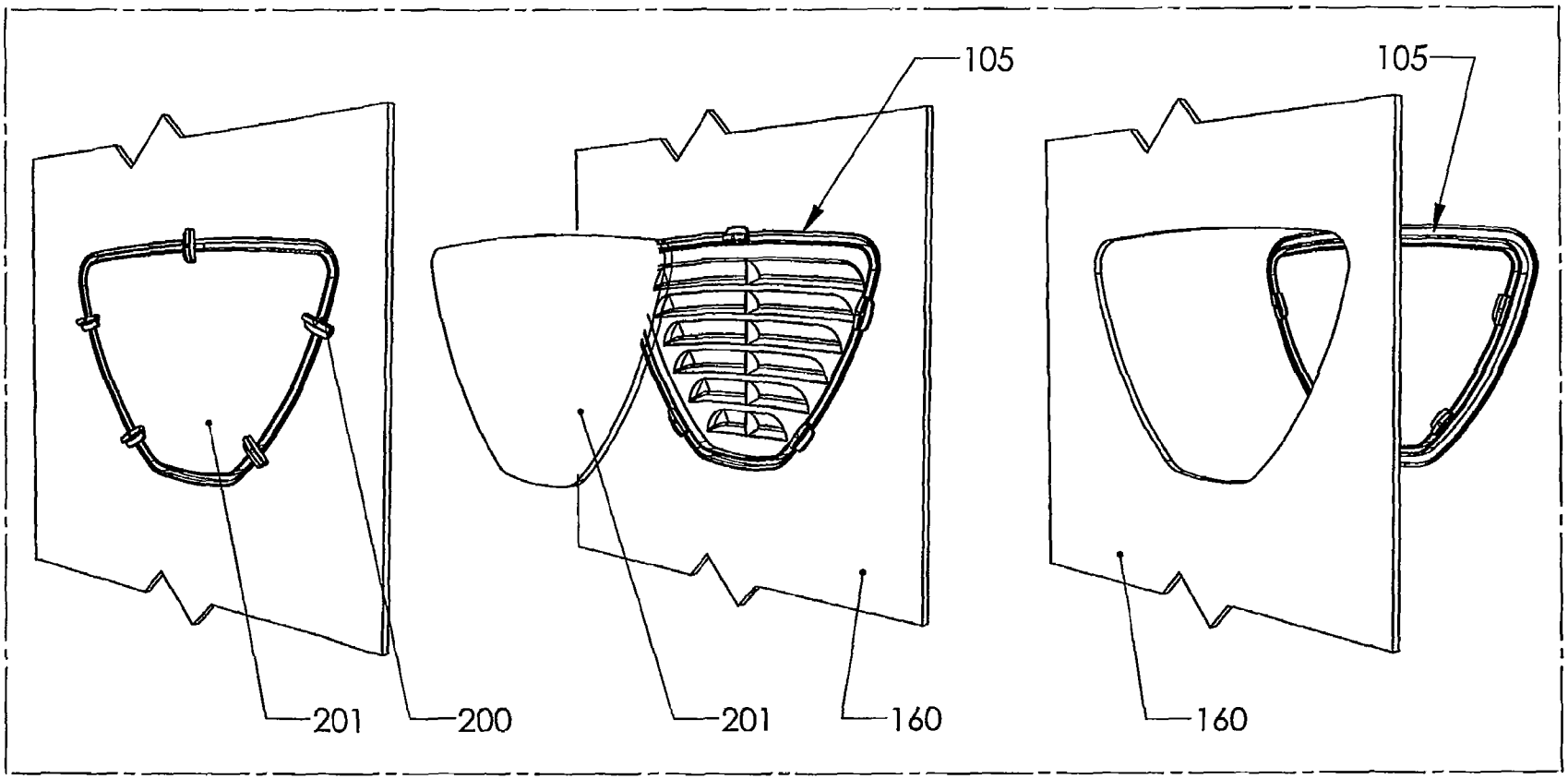
FIG. 10 is an exploded perspective view of the three stages of the assembly, proceeding from right to left, of a louver being fitted into an end wall of the building structure, with a closure plate aligned for fitting to the louver being present in the exploded view at the second stage and installed in place on the interior surface of the louver as part of the first and last steps.
Figure 10B:
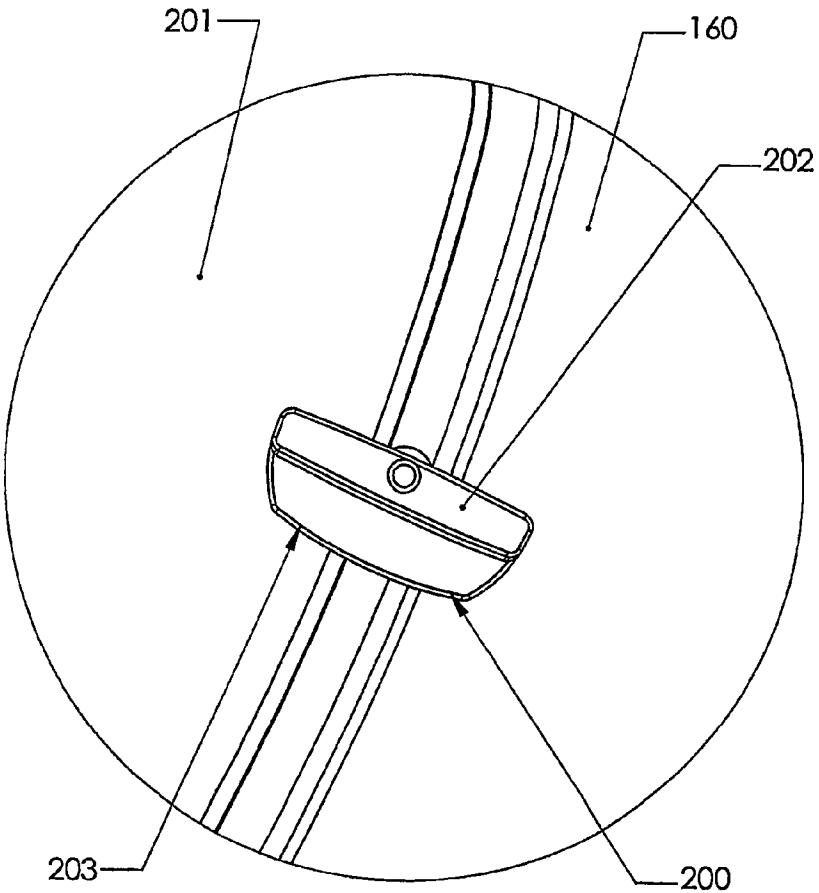
FIG. 10B is a detailed close-up view of the finger of FIG. 10A rotated for retention of both the closure plate on the louver and the louver in place within the end wall opening.
Figure 10A:
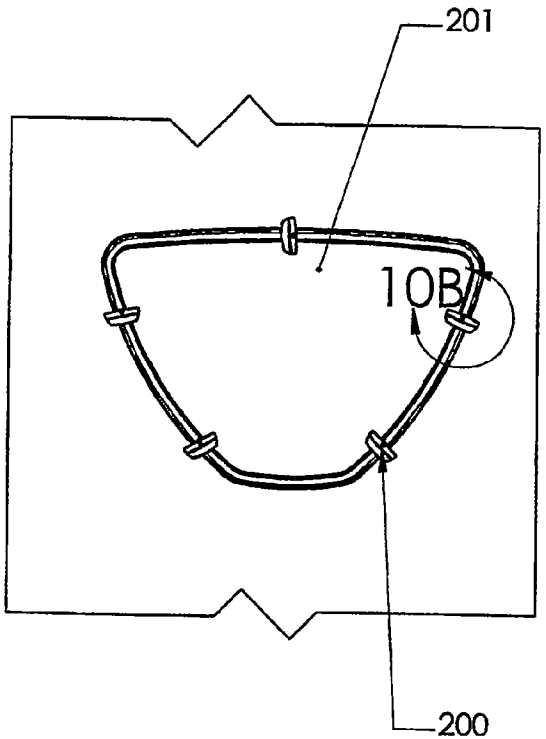
FIG. 10A is a face view of the interior side of the louver showing fingers oriented for retention of the louver in an opening on the end wall, while retaining the closure plate in place.

The end panels of the building may be provided, a shown in FIGS. 1 and 10, with a louver 105 mounted in an upper position in order to permit air to enter and freshen the interior. This louver 105 may be press-fitted into an opening cut in an end panel 160. Rotating fingers 200 along the inner edges of the louver 105 may then be oriented to overlie the inside surface of the end panel 160 into which the louver 105 is fitted. This retains the louver 105 in place.

The louver 105 may also be provided with a closure plate 201 which fits into the louver 105 on its inside face. The same rotatable fingers 200 may be positioned to overlie this plate 201, once in position, and retain it in place. As a particular feature relating to the rotatable fingers 200, such fingers may be a-symmetrical, being narrower on one side 202 and wider on the other side 203. The narrower side 202 of each finger 200 may be aligned with the edge of the opening cut to receive the louver 105, permitting the louver 105 to be removed from, or inserted into, the opening in the end wall 160. In such conditions, the wider side 203 of each finger 200 will nevertheless overlie the closure plate 201 retaining it with the louver 105. Rotation of such fingers 200 by 180° so that the wider side 203 overlies the end wall 160 will permit removal of the closure plate 201 from the louver 105. Rotation of such fingers 200 by 90° will position such fingers to overlie the closure plate 201 retaining it in place, as well as overlying the edge of the opening in the end wall 160 to retain the lower 105 in place.

Figures 11, 11A, 11B:
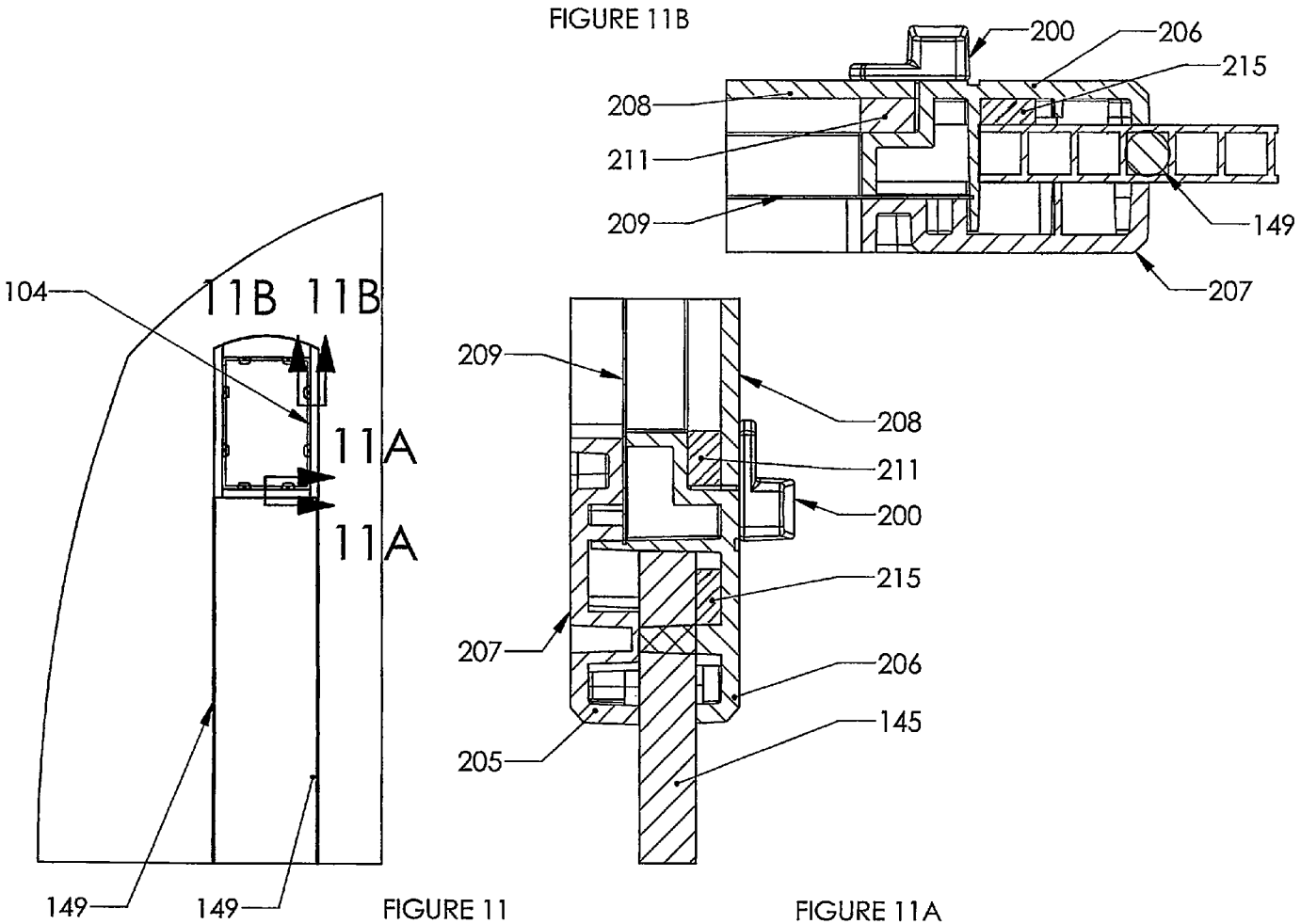
FIG. 11 is face view of an end wall of the building structure including a window assembly and window frame mounted therein showing the directions of the cross-sectional views, FIGS. 11A, B and the reinforcing rods in the end wall panel.
FIG. 11A is a vertical cross-sectional of the window frame and window assembly of FIG. 11.
FIG. 11B is a horizontal, upwardly directed, cross-sectional of a window frame and window assembly of FIG. 11.

Windows 104, as shown in FIG. 11, may be fitted into openings in the walls, particularly the end walls 160 of the building structure 100. When the end walls 160 are formed of the special reinforced panels 145 of the invention, the reinforcing rods 149 within such panels are positioned, as shown in FIGS. 11, 11B, to be in-register with the periphery of the window frame 205. The stiffening batten means 149 extend into the opening formed in the end walls 160 to accommodate the frame 205 of the window 104, or along the side of such opening, and be embraced by such window frame 205. This provides improved structural integrity for the alignment and retention of the window frame 205 within its opening in the building walls.

The window 104 may incorporate outer and inner frame portions 206, 207 that may be pressed into an opening in an end wall 160 of the structure 100, such frame portions 206, 207 embracing the edges of the paneling 145 forming the boundaries of such opening. Conveniently, a reinforcing rod 149 within the paneling 145 is thereby embraced between the outer and inner frame portions 206, 207.

The two frame portions 206, 207 may be shaped to receive either a windowpane 208 or a window screen 209 which may be slidingly installed within the window frame 205. Fingers 200 on the outer portion of the window frame 206 may retain the windowpane 208 in place.

Figure 11D:
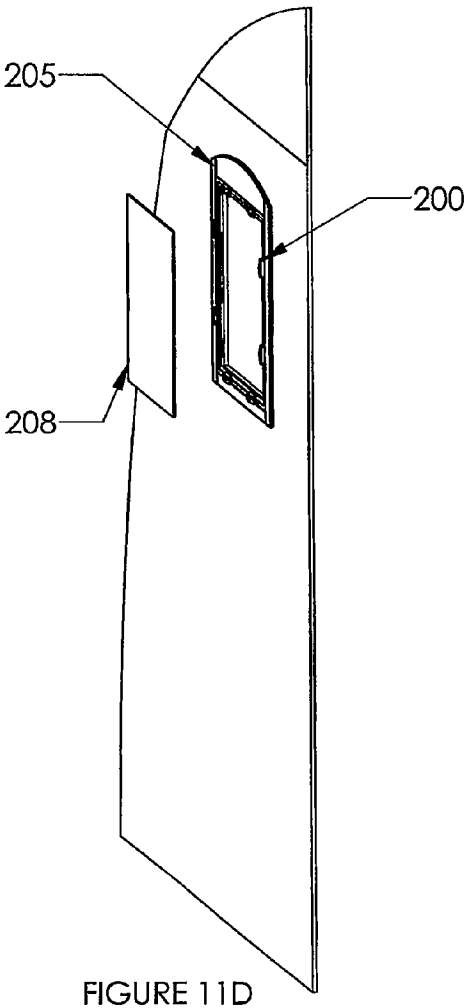
FIG. 11D is an exploded perspective of the window frame and assembly of FIG. 11 fully installed except for a pane of glass or plastic that is positioned for fitting into such frame.
Figure 11C:
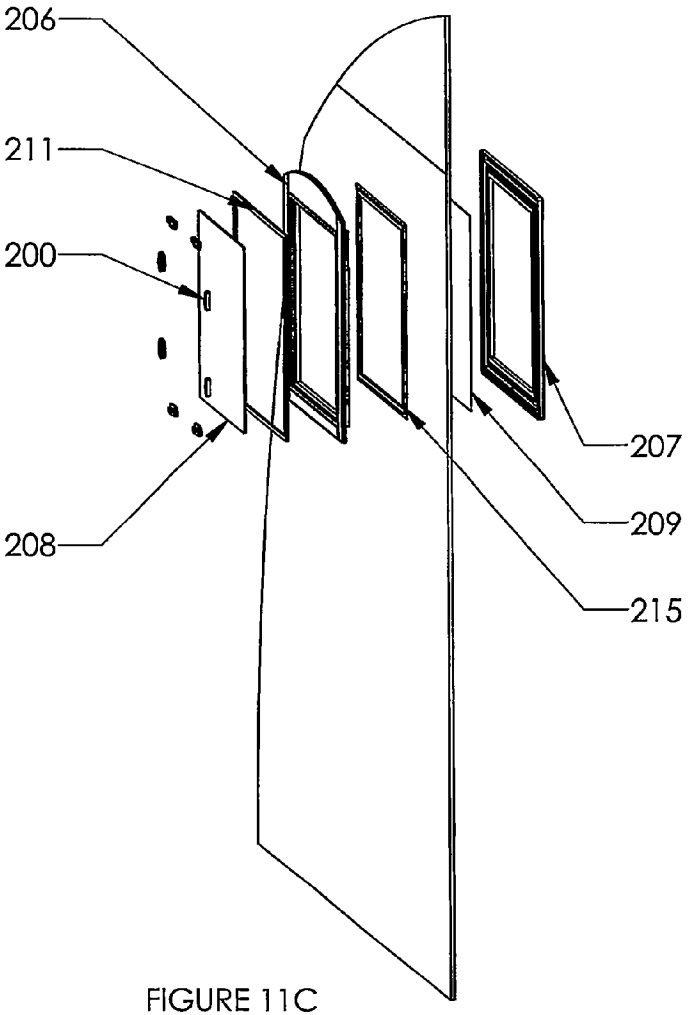
FIG. 11C is an exploded perspective of the window frame and window assembly of FIG. 11.

As shown in FIGS. 11A, B and C, the outer 206 and inner 207 frame portions contain a screen 209 and wall gasket 215. The outer frame 206 then receives an outer frame gasket 211 and windowpane 208 that is retained in place by fingers 200. In FIG. 11D the window pane 208 is shown as it is being inserted into the window frame 205 for retention by the fingers 200.

A door 103, as shown in FIGS. 1 and 2, may be provided by including two pair of vertical stiffening posts 210 in one of the end walls 160 of the building and fitting a door frame there between. Preferably, the end panels in the end walls 160 are provided with improved structural integrity by diagonal members 111 that extend down from an upper portion of the end arch to the vicinity of the doorframe where it meets the base member 138 extending around the perimeter of the structure.

Accordingly, it has been shown how a new, improved building component in the form of a curved panel may be integrated into a frame structure to provide an effective and efficient temporary or emergency shelter.

CONCLUSION

While the variations and departures from the structure as described may be accommodated, the essential character of a shelter built in accordance with the invention will be apparent from the foregoing disclosure. The foregoing has constituted a description of specific embodiments showing how the invention may be applied and put into use. These embodiments are only exemplary. The invention in its broadest, and more specific aspects, is further described and defined in the claims, which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The invention claimed is:

1. A building structure comprising:

a) a framework, having a plurality of longitudinally spaced-apart arches;

b) a longitudinal member that extends down the length of the entire building structure along the top of each of the arches to serve as a ridgepole;

c) the top of each arch comprising a transverse truss having two lateral truss ends, each truss includes an upper arced tube-like member and a lower arced tube-like member extending between the two truss ends whereat such members are joined at their respective ends by a truss end bracket, the lower arced member being upwardly curved with a curvature which is less than the curvature of the upper arced tube-like member to provide a web opening between such components;

d) a "V"-shaped web member which is symmetrically mounted on the lower arced member of the truss at its center point, such "V"-shaped web member extending upwardly and outwardly from such center point of the lower arced member, across the web opening to connect with the upper arced tube-like member at two locations which are located symmetrically on either side of the mid-point of the upper arced tube-like member, wherein the apex is connected at the central point by a bracket having upwardly extending flange-like wings that are fastened to the "V"-shaped web member on either side of its lower apex, which flanges are also fastened to the central portion of the lower arced tube-like member.

2. A building structure comprising:

a) a framework, having a plurality of longitudinally spaced-apart arches;

b) a longitudinal member that extends down the length of the entire building structure along the top of each of the arches to serve as a ridgepole;

c) the top of each arch comprising a transverse truss having two lateral truss ends, each truss includes an upper arced tube-like member terminating at its respective outer ends at a truss end bracket, wherein each arch is provided with two generally upright curved side members that extend upwardly from their bottom ends to terminate at the upper most ends at a truss end bracket each of the side members being curved so as to be outwardly convex with a curvature for the side member which has a different center of curvature from that of the upper arced tube-like member;

d) a mid-wall horizontal member that extends longitudinally down both sides of the building structure at the height of the truss end brackets, generally parallel to the ridgepole;

e) a base member extending longitudinally for the length of the building on either side of such building positioned along the bottom of each of said arches to maintain the spacing between said arches; and f) a bottom channel member, with the cross-sectional profile of an upwardly-open "U" channel, connected to and extending longitudinally with said base member with the opening of the "U" channel upwardly directed for receiving the lower edge of wall cladding in the form of the panels.

3. The building structure as in claim 2 comprising:

g) a longitudinally-extending generally S-profile channel member extending respectively down the two sides of the building mounted along and coupled to the mid-wall longitudinal member, an outer portion of each S-profile channel member being upwardly open and an inner portion of each S-profile channel member being downwardly open, and h) cladding in the form of a plurality of panels of a width equal to the distance separating the arches, each panel being fitted between adjacent arches on both sides of the structure along the side members of the structure, wherein the lower edge of each of the panels is seated into the upwardly open "U" channel of the bottom channel member and the upper edge of each of the panels is seated in the inner, downwardly open portion of a S-profile channel member.

4. The building structure as in claim 3 comprising:

i) roof cladding in the form of a plurality of panels of a width equal to the distance separating the arches, each panel being fitted between adjacent arches on both sides of the structure along the truss members of the structure, the lower edge of each of the panels being seated into the upwardly open outer portion of each S-profile channel member and extending upwardly and inwardly to form roof cladding panels.

5. The building structure as in claim 4 wherein:

j) a ridgeline bracket assembly carried by the ridgepole to receive the upper ends of the roof cladding panels, the ridgeline bracket assembly including a first ridgeline channel component connected to the ridgepole and having an upper horizontal portion which provides a horizontal surface to receive and underlie the upper ends of the roof cladding panels, and a second ridgeline channel component which is connected to the first ridgeline channel component and which includes flanges to overlie the upper ends of the roof cladding panels, whereby the roof cladding panels are contained in place to provide a roofing surface for the building structure.

6. The building structure as in claim 5 wherein the first ridgeline channel component has the general cross-sectional shape of an inverted triangle with an open bottom in place of the normal, lower, triangle apex whereby the first ridgeline channel component embraces the ridgepole with a grasping engagement through this open bottom.

7. The building structure as in claim 6 were in the first ridgeline channel component has a "U"-shaped central channel formed therein along its topside surface, and the second ridgeline channel component has a downwardly-extending "U"-shaped rail which inter-fits with the "U"-shaped central channel of the first ridgeline channel component.

8. The building structure as in claim 7 wherein the ridgeline bracket assembly includes a ridge-capping plate, overlying and fastened to the second ridgeline channel component.

9. The building structure as in claim 4 wherein:

a) a ridgeline bracket assembly carried by the ridgepole to receive the upper ends of the roof cladding panels, the ridgeline bracket assembly including a first ridgeline channel component connected to the ridge-pole and having an upper horizontal portion which provides a horizontal surface to receive and underlie the upper ends of the roof cladding panels, and a second ridgeline channel component which is connected to the first ridgeline channel component and which includes flanges to overlie the upper ends of the roof cladding panels, whereby the roof cladding panels are contained in place to provide a roofing surface for the building structure.

10. The building structure as in claim 3 wherein said panels comprise:

a) a first sheet of a resiliently flexible material;

b) a second sheet of a resiliently flexible material spaced apart a fixed distance from said first sheet of a material;

c) a plurality of spaced-apart strips extending between said first and second sheets of material to form webs adjoining the first and second sheets, such webs being interspersed by hollow channels; and d) one or more of resiliently flexible rod-like reinforcing members, said reinforcing members being disposed within one or more selected hollow channels wherein said panel with reinforcing members may be curved with the reinforcing members serving as reinforcing battens.

11. The building structure as in claim 3 comprising a corrugated strapping member overlying the side members and containing the vertical edges of the cladding panels there between, such strapping member being curved to follow the curvature of the arch on which it is mounted.

12. The building structure as in claim 11 comprising linear gaskets contained between the corrugated strapping member and the vertical edges of the cladding to provide a seal against the environment.

13. The building structure of claim 11 wherein the corrugated strapping extending along the arches at the respective ends of the building structure includes an additional flange which is bent around the corner of the arches to overlie the end faces of such arches and contain wall paneling used to close off the end of the building structure.

14. A package for assembly of the building structure according to claim 3 comprising:

members to form said plurality of longitudinally spaced-apart arches of said framework of said building structure;

one or more members to form said longitudinal member;

one or more members to form said mid-wall horizontal member;

one or more members to form said bottom channel member;

one or more members to form said base member;

one or more members to form said S-profile channel member; and said plurality of panels to form said cladding.

15. The building structure as in claim 2 comprising a curved retainer plate which is connected to the building structure so as to be positioned over the base member and provide a containment means for retaining a floor covering, the edge of which extends to cover an overlie the base member, in place within the structure.

16. The building structure as in claim 2 comprising end panels for the building, such end panels comprising:

a) two exterior surface sheets coupled together by multiple longitudinal interior webs that define a plurality of tubular passageways extending between and along the length of such panel; and b) stiffening means in the form of at least one stiffening rod-like member that is confined within and extends along a corresponding tubular passageway within the panel, said rod-like member being longitudinally stiff but being laterally elastically flexible such that it will bend when the panel containing such rod-like member is flexed to introduce a curvature into the tubular passageways, whereby such rod-like member act as battens to provide a stiffening effect to the panels.

17. The building structure as in claim 16 comprising:

a) a window frame fitted into an opening in one of the end panels at a location wherein the stiffening means extends into the opening or within the periphery of the window frame and is embraced by the window frame.

18. The building structure as in claim 2 comprising end panels for the building, such end panels comprising:

a) an opening for receiving an air ventilation louver;

b) an air ventilation louver a dimension to sit within said opening and including rotating fingers along the inner edges of the louver that may be oriented to overlie the inside surface of the end panel into which the louver is fitted and retain the louver in place;

c) a closure plate which fits into the louver on its inside face, wherein the rotatable fingers may be positioned to overlie this plate, once in position, and retain it in place against the louver.

19. The building structure as in claim 18 wherein the rotatable fingers are a-symmetrical about their centers of rotation, being wider on one side and narrower on the other side whereby the narrower side of each finger may be aligned with the edge of the opening cut to receive the louver, permitting the louver to be removed from, or inserted into, the opening in the end wall while, the wider side of each finger will nevertheless overlie the closure plate retaining it with the louver and wherein further rotation of such fingers will permit removal of the closure plate from the louver.

20. A package for assembly of the building structure according to claim 2 comprising:

members to form said plurality of longitudinally spaced-apart arches of said framework of said building structure;

one or more members to form said longitudinal member one or more members to form said mid-wall horizontal member;

one or more members to form said base member; and one or more members to form said bottom channel member.

21. A building structure comprising:

a) a framework having a plurality of longitudinally spaced-apart arches; and b) cladding in the form of a plurality of panels, wherein each of said panels comprises:

a first sheet of a resiliently flexible material;

a second sheet of a resiliently flexible material spaced apart a fixed distance from said first sheet of a material;

a plurality of spaced-apart strips extending between said first and second sheets of material to form webs adjoining the first and second sheets, such webs being interspersed by hollow channels; and one or more resiliently flexible rod-like reinforcing members, said reinforcing members being disposed within one or more selected hollow channels wherein said panel with reinforcing members may be curved with the reinforcing members serving as reinforcing battens; and wherein each of said panels is curved to follow the curvature of said arches.

22. A package for assembly of the building structure according to claim 21 comprising:

said plurality of panels to form said cladding of said building structure and members to form said plurality of longitudinally spaced-apart arches of said framework of said building structure.

23. A building structure comprising:

a) a framework, having a plurality of longitudinally spaced-apart arches;

b) a longitudinal member that extends down the length of the entire building structure along the top of each of the arches;

c) a mid-wall horizontal member that extends longitudinally down both sides of the building;

d) a base member extending longitudinally for the length of the building on either side of such building positioned along the bottom of each of said arches;

e) a bottom channel member, with the cross-sectional profile of an upwardly-open "U" channel, extending longitudinally with said base member with the opening of the "U" channel upwardly directed for receiving the lower edge of wall cladding in the form of the panels;

f) a longitudinally-extending generally S-profile channel member extending respectively down the two sides of the building mounted along to the mid-wall longitudinal member, an outer portion of each S-profile channel member being upwardly open and an inner portion of each S-profile channel member being downwardly open; and g) cladding in the form of a plurality of panels, wherein the lower edge of each of the panels is seated into the upwardly open "U" channel of the bottom channel member and the upper edge of each of the panels is seated in the inner, downwardly open portion of a S-profile channel member.

24. A package for assembly of the building structure according to claim 23 comprising:

members to form said plurality of longitudinally spaced-apart arches of said framework of said building structure;

one or more members to form said longitudinal member;

one or more members to form said mid-wall horizontal member;

one or more members to form said bottom channel member;

one or more members to form said base member;

one or more members to form said S-profile channel member; and said plurality of panels to form said cladding.

* * * * *